US011243484B2

(12) United States Patent
Sato

(10) Patent No.: US 11,243,484 B2
(45) Date of Patent: Feb. 8, 2022

(54) IMAGE FORMING APPARATUS INCLUDING DEVELOPING DEVICE WHICH HAS DEVELOPING CASING MOVABLE RELATIVE TO PHOTOSENSITIVE DRUM, AND TONER CARTRIDGE WHICH SUPPLIES TONER TO DEVELOPING DEVICE

(71) Applicant: BROTHER KOGYO KABUSHIKI KAISHA, Nagoya (JP)

(72) Inventor: Shougo Sato, Seto (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/340,530

(22) Filed: Jun. 7, 2021

(65) Prior Publication Data

US 2021/0405582 A1 Dec. 30, 2021

(30) Foreign Application Priority Data

Jun. 29, 2020 (JP) ..... JP2020-112096

(51) Int. Cl.
*G03G 15/08* (2006.01)
*G03G 21/18* (2006.01)

(52) U.S. Cl.
CPC ..... *G03G 15/0886* (2013.01); *G03G 15/0881* (2013.01); *G03G 15/0868* (2013.01); *G03G 21/1832* (2013.01); *G03G 2215/0692* (2013.01); *G03G 2221/1624* (2013.01); *G03G 2221/1853* (2013.01)

(58) Field of Classification Search
CPC ..... G03G 15/0868; G03G 15/0881; G03G 15/0886; G03G 21/1832; G03G 2215/0692; G03G 2221/1624; G03G 2221/1853
See application file for complete search history.

(56) References Cited

U.S. PATENT DOCUMENTS

2003/0039484 A1 2/2003 Naito et al.
2013/0272750 A1* 10/2013 Matsumoto ..... G03G 15/0865 399/262
2015/0177648 A1* 6/2015 Morishita ..... G03G 15/0886 399/358
2019/0286011 A1* 9/2019 Nieda ..... G03G 15/0886

FOREIGN PATENT DOCUMENTS

JP 2003-066815 A 3/2003

* cited by examiner

*Primary Examiner* — Joseph S Wong
(74) *Attorney, Agent, or Firm* — Merchant & Gould P.C.

(57) ABSTRACT

An image forming apparatus includes comprising a main body casing, a drum cartridge, and a toner cartridge. The drum cartridge includes a photosensitive drum, a developing device, a developing casing, and a developing shutter. The developing device includes a developing roller, a developing casing, and a developing shutter. The toner cartridge includes a toner casing, a toner shutter, and a cushion member. The cushion member is positioned between the toner casing and the toner shutter. The cushion member is configured to allow the toner shutter, while the toner shutter is engaged with the developing casing, to move relative to the toner casing when the developing casing moves relative to the photosensitive drum in a state where the drum cartridge and the toner cartridge are attached in the main body casing, the developing shutter is in a developing open position, and the toner shutter is in a toner open position.

17 Claims, 12 Drawing Sheets

IMAGE FORMING APPARATUS INCLUDING DEVELOPING DEVICE WHICH HAS DEVELOPING CASING MOVABLE RELATIVE TO PHOTOSENSITIVE DRUM, AND TONER CARTRIDGE WHICH SUPPLIES TONER TO DEVELOPING DEVICE

CROSS REFERENCE TO RELATED APPLICATION

This application claims priority from Japanese Patent Application No. 2020-112096 filed Jun. 29, 2020. The entire content of the priority application is incorporated herein by reference.

TECHNICAL FIELD

The present disclosure relates to image forming apparatus.

BACKGROUND

Conventionally, an image forming apparatus includes a drum cartridge and a toner cartridge. The drum cartridge includes a photosensitive drum and a developing device. The developing device is configured to supply toner to the photosensitive drum. The toner cartridge is configured to supply toner to the developing device in a state where the toner cartridge is attached to the drum cartridge. The developing device includes a developing roller, a developing casing, and a developing shutter. The developing casing supports the developing roller. The developing casing is formed with a toner inlet. The toner inlet allows toner to be introduced from the toner cartridge into the developing casing in the state where the toner cartridge is mounted to the drum cartridge. The developing shutter is configured to open or close the toner inlet. The toner cartridge includes a toner casing and a toner shutter. The toner casing is configured to accommodate toner therein. The toner casing is formed with a toner outlet. The toner outlet is configured to discharge toner in the toner casing to an outside of the toner casing. The toner shutter is configured to open or close the toner outlet. Such an image forming apparatus is disclosed in the United States Patent Application Publication No. 2003/0039484A1.

SUMMARY

It is conceivable to modify the image forming apparatus disclosed in the United States Patent Application Publication No. 2003/0039484A1 such that the developing roller and the developing casing that supports the developing roller are movable relative to the photosensitive drum, in order to suppress changes in the contacting state in which the developing roller is in contact with the photosensitive drum.

However, when the developing casing moves, the position of the toner inlet of the developing casing relative to the toner shutter of the toner casing may change, and this may cause part of toner supplied from the toner cartridge to the developing casing to leak.

In view of the foregoing, it is an object of the disclosure to provide an image forming apparatus that has a configuration, in which toner is supplied from a toner cartridge to a developing casing that is movable relative to a photosensitive drum, and that can suppress toner from leaking when toner is supplied from the toner cartridge to the developing casing.

In order to attain the above and other objects, according to one aspect, the disclosure provides an image forming apparatus including comprising a main body casing, a drum cartridge, and a toner cartridge. The drum cartridge is attachable in the main body casing. The drum cartridge includes a photosensitive drum, a developing device, a developing casing, and a developing shutter. The photosensitive drum is rotatable about a drum axis which extends in a first direction. The developing device is configured to supply toner to the photosensitive drum. The toner cartridge is attachable in the main body casing. The toner cartridge is configured to supply toner to the developing device in a state where the drum cartridge and the toner cartridge are attached in the main body casing. The developing device includes a developing roller, a developing casing, and a developing shutter. The developing roller is rotatable about a developing axis which extends in the first direction. The developing casing supports the developing roller. The developing casing is movable relative to the photosensitive drum in a second direction which crosses the first direction. The developing casing is formed with a toner inlet configured to allow toner supplied from the toner cartridge into the developing casing in the state where the drum cartridge and the toner cartridge are attached in the main body casing. The developing shutter is movable between a developing closed position and a developing open position. The developing shutter is configured to close the toner inlet when the developing shutter is in the developing closed position. The developing shutter is configured to open the toner inlet when the developing shutter is in the developing open position. The toner cartridge includes a toner casing, a toner shutter, and a cushion member. The toner casing is configured to store toner therein. The toner casing is formed with a toner outlet which is configured to discharge toner from an inside of the toner casing. The toner shutter is movable between a toner closed position and a toner open position. The toner shutter is configured to close the toner outlet when the toner shutter is in the toner closed position. The toner shutter is configured to open the toner outlet when the toner shutter is in the toner open position. The toner shutter is configured to be engaged with the developing casing in the state where the drum cartridge and the toner cartridge are attached in the main body casing. The cushion member is positioned between the toner casing and the toner shutter. The cushion member is configured to allow the toner shutter, while the toner shutter is engaged with the developing casing, to move relative to the toner casing when the developing casing moves relative to the photosensitive drum in a state where the drum cartridge and the toner cartridge are attached in the main body casing, the developing shutter is in the developing open position, and the toner shutter is in the toner open position.

BRIEF DESCRIPTION OF THE DRAWINGS

The particular features and advantages of the disclosure will become apparent from the following description taken in connection with the accompanying drawings, in which.

DETAILED DESCRIPTION

1. Image Forming Apparatus 1

Figure 1:
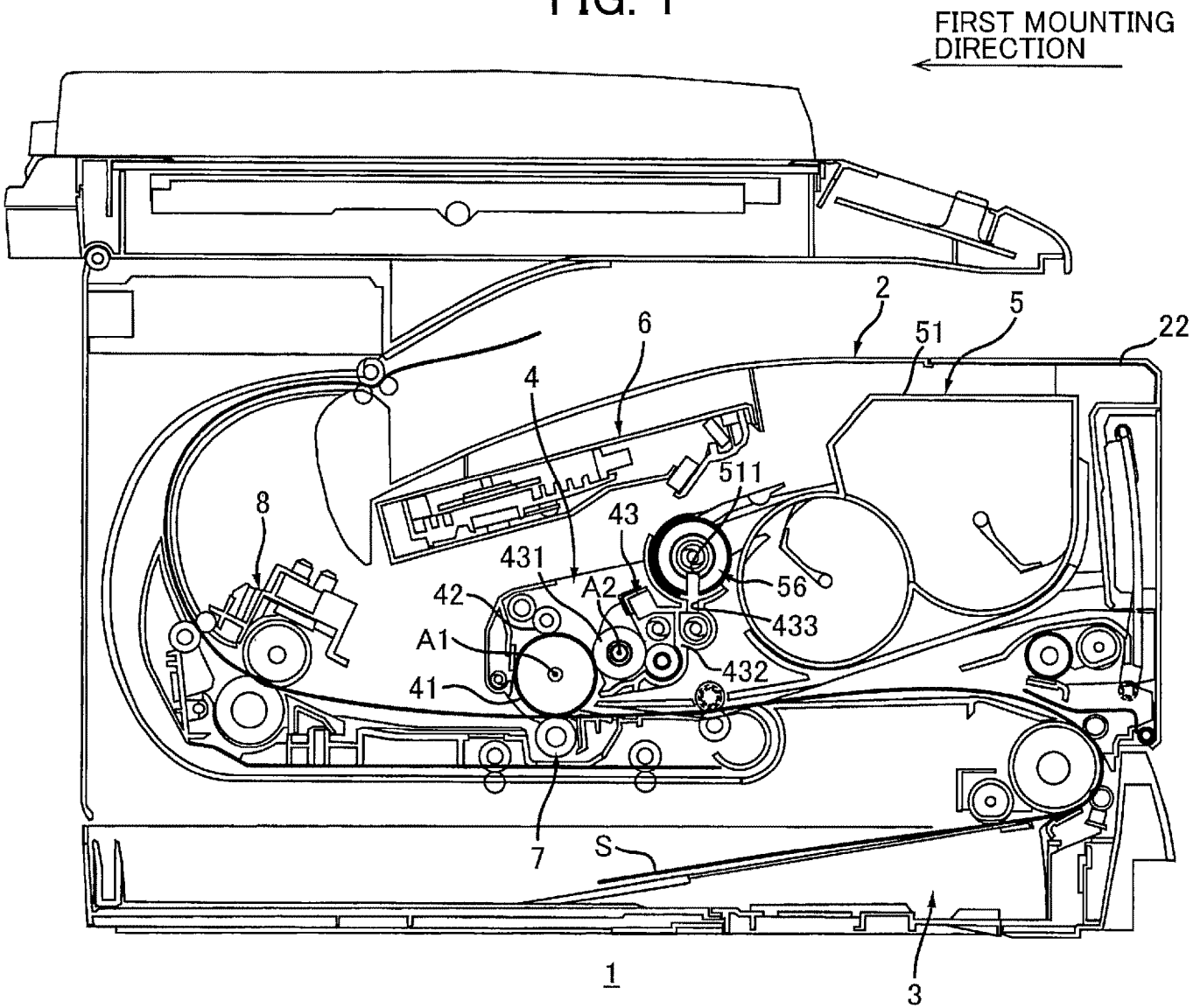
FIG. 1 is a schematic view of an image forming apparatus according to an embodiment of the present disclosure.
Figure 2:
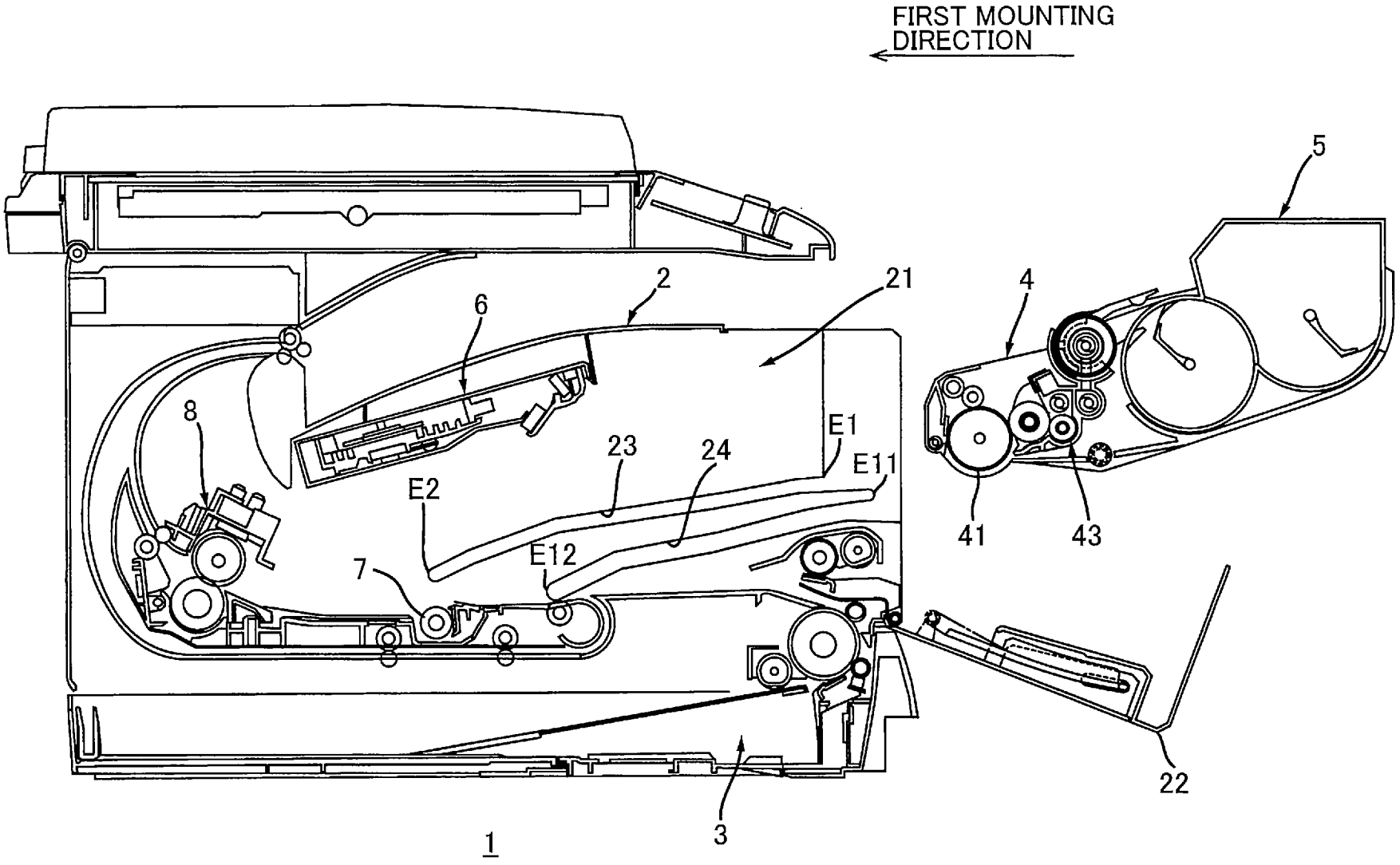
FIG. 2 is a schematic view illustrating a state in which a drum cartridge shown in FIG. 1 is removed from a main body casing of the image forming apparatus.
Figure 3:
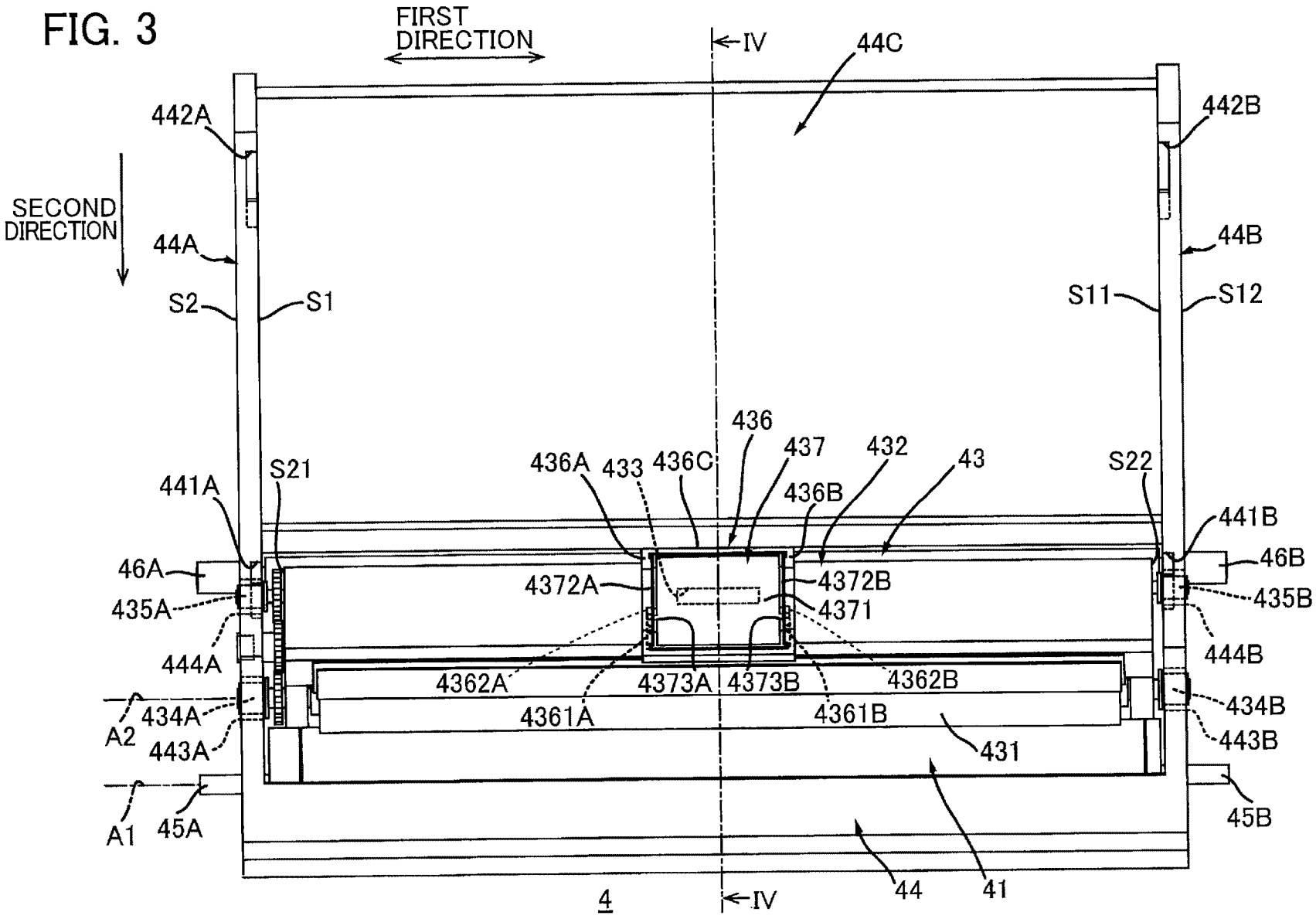
FIG. 3 is a plan view of the drum cartridge shown in FIG. 1.

With reference to FIGS. 1 to 3, an image forming apparatus 1 will be described.

As illustrated in FIG. 1, the image forming apparatus 1 includes a main body casing 2, a sheet cassette 3, a drum cartridge 4, a toner cartridge 5, an exposure device 6, a transfer device 7, and a fixing device 8.

1.1 Main Body Casing 2

The main body casing 2 accommodates the sheet cassette 3, the drum cartridge 4, the toner cartridge 5, the exposure device 6, the transfer device 7, and the fixing device 8.

As illustrated in FIG. 2, the main body casing 2 has an opening 21. The main body casing 2 includes a cover 22, a guide 23, and a guide 24.

The opening 21 is formed in a side wall of the main body casing 2 that is disposed at one side in a first mounting direction. The first mounting direction corresponds to a direction in which the drum cartridge 4 moves relative to the main body casing 2 when the drum cartridge 4 is mounted into the inside of the main body casing 2. Specifically, the first mounting direction corresponds to a direction in which the guide 23 extends.

The cover 22 is movable between a closed position (see FIG. 1) and an open position (see FIG. 2). The cover 22 is configured to close the opening 21 when the cover 22 is in the closed position. The opening 21 is open when the cover 22 is in the open position.

The guide 23 is configured to guide a projection 45A of the drum cartridge 4 (see FIG. 3). The projection 45A will be described later. The guide 23 extends in the first mounting direction. The guide 23 has a first end E1 and a second end E2 in the first mounting direction. The first end E1 is positioned between the second end E2 and the cover 22 in the first mounting direction when the cover 22 is in the closed position. The second end E2 is positioned apart from the first end E1 in the first mounting direction. The guide 23 is a groove. Alternatively, the guide 23 may be a rib.

The guide 24 is configured to guide a projection 46A of the drum cartridge 4 (see FIG. 3). The projection 46A will be described later. The guide 24 extends in the first mounting direction along with the guide 23. The guide 24 and the guide 23 are arranged side by side in a direction perpendicular to the first mounting direction. The guide 24 has a first end E11 and a second end E12. The first end E11 is positioned between the second end E12 and the cover 22 in the first mounting direction when the cover 22 is in the closed position. The second end E12 is positioned apart from the first end E11 in the first mounting direction. The guide 24 is a groove. Alternatively, the guide 24 may be a rib.

1.2 Sheet Cassette 3

As illustrated in FIG. 1, the sheet cassette 3 is configured to accommodate sheets S therein. A sheet S in the sheet cassette 3 is conveyed toward a photosensitive drum 41 of the drum cartridge 4. The photosensitive drum 41 will be described later.

1.3 Drum Cartridge 4

The drum cartridge 4 is configured to be mounted in the inside of the main body casing 2. Specifically, the drum cartridge 4 is mounted into the inside of the main body casing 2 through the opening 21 (see FIG. 2) when the cover 22 is in the open position. The drum cartridge 4 is fixed in position with respect to the main body casing 2 in a state where the drum cartridge 4 is mounted in the inside of the main body casing 2. Specifically, in the state where the drum cartridge 4 is mounted in the inside of the main body casing 2, the projection 45A (see FIG. 3) is fitted in the second end E2 of the guide 23 (see FIG. 2) and the projection 46A (see FIG. 3) is fitted in the second end E12 of the guide 24 (see FIG. 2). In this state, the drum cartridge 4 is fixed in position with respect to the main body casing 2. The drum cartridge 4 can be mounted in the inside of the main body casing 2, with the toner cartridge 5 being mounted to the drum cartridge 4. The drum cartridge 4 includes the photosensitive drum 41, a charging device 42, and a developing device 43.

1.3.1 Photosensitive Drum 41

The photosensitive drum 41 extends in the first direction. The first direction intersects with the first mounting direction. Preferably, the first direction is orthogonal to the first mounting direction. The photosensitive drum 41 is rotatable about a drum axis A1. The drum axis A1 extends in the first direction.

The charging device 42 is configured to charge a surface of the photosensitive drum 41. In the present embodiment, the charging device 42 is a charging roller. The charging device 42 is in contact with the surface of the photosensitive drum 41. The charging device 42 may be a scorotron charging device.

The developing device 43 is configured to supply toner to the photosensitive drum 41. The developing device 43 includes a developing roller 431 and a developing casing 432.

The developing roller 431 extends in the first direction. The developing roller 431 is rotatable about a developing axis A2. The developing axis A2 extends in the first direction. The developing roller 431 is configured to supply toner in the developing casing 432 to the photosensitive drum 41. In the present embodiment, the developing roller 431 is disposed in contact with the photosensitive drum 41. The developing roller 431 may be disposed at a position apart from the photosensitive drum 41 by a predetermined distance.

The developing casing 432 stores therein toner to be supplied to the photosensitive drum 41. The developing casing 432 supports the developing roller 431. The developing casing 432 is formed with a toner inlet 433.

The toner inlet 433 is configured to allow toner to be introduced from the toner cartridge 5 into the developing casing 432 in the state where the drum cartridge 4 and the toner cartridge 5 are mounted in the inside of the main body casing 2.

1.4 Toner Cartridge 5

The toner cartridge 5 is configured to be mounted in the inside of the main body casing 2. In the present embodiment, the toner cartridge 5 is configured to be mounted to the drum cartridge 4 in a state where the drum cartridge 4 is outside the main body casing 2. The toner cartridge 5 is mounted into the inside of the main body casing 2 when the drum cartridge, to which the toner cartridge is mounted, is mounted into the inside of the main body casing 2. The toner cartridge 5 is positioned at an opposite side of the photosensitive drum 41 with respect to the developing roller 431 in the state where the toner cartridge 5 is mounted in the drum cartridge 4. The toner cartridge 5 includes a toner casing 51.

The toner casing 51 is configured to store toner to be supplied to the developing device 43. The toner casing 51 is formed with a toner outlet 511.

The toner outlet 511 is configured to discharge the toner in the toner casing 51 to the outside of the toner casing. In the state where the drum cartridge 4 and the toner cartridge 5 are mounted in the inside of the main body casing 2, toner discharged from the toner outlet 511 is introduced into the developing device 43 via the toner inlet 433. Thus, the toner cartridge 5 supplies toner to the developing device 43 in the state where the drum cartridge 4 and the toner cartridge 5 are mounted in the inside of the main body casing 2. The toner outlet 511 is positioned at a vertical level higher than the toner inlet 433 in the state where the drum cartridge 4 and the toner cartridge 5 are mounted in the inside of the main body casing 2. This allows toner to be supplied from the toner cartridge 5 to the developing device 43 due to gravitational force.

1.5 Exposure Device 6

In the state where the drum cartridge 4 and the toner cartridge 5 are mounted in the main body casing 2, the exposure device 6 exposes the surface of the photosensitive drum 41 that is charged by the charging device 42. The developing device 43 supplies toner to the exposed surface of the photosensitive drum 41. In the present embodiment, the exposure device 6 is a laser scan unit. The exposure device 6 may instead be an LED head.

The transfer device 7 is configured to transfer toner on the photosensitive drum 41 onto the sheet S. Specifically, the sheet S supplied from the sheet cassette 3 passes between the transfer device 7 and the photosensitive drum 41. At this point, the transfer device 7 transfers the toner on the photosensitive drum 41 onto the sheet S. In the present embodiment, the transfer device 7 is a transfer roller. The transfer device 7 is configured to be in contact with the photosensitive drum 41 in the state where the drum cartridge 4 is mounted in the main body casing 2. The transfer device 7 may be disposed at a position apart from the photosensitive drum 41 by a predetermined distance in the state where the drum cartridge 4 is mounted in the main body casing 2.

The fixing device 8 is configured to fix toner to the sheet S. In the present embodiment, the fixing device 8 fixes toner to the sheet S by applying heat and pressure to the sheet S onto which the toner has been transferred. The sheet S that has passed through the fixing device 8 is discharged onto an upper surface of the main body casing 2.

2. Detailed Configuration of Drum Cartridge

With reference to FIGS. 3 to 8, the drum cartridge 4 will be described in detail.

Figure 4:
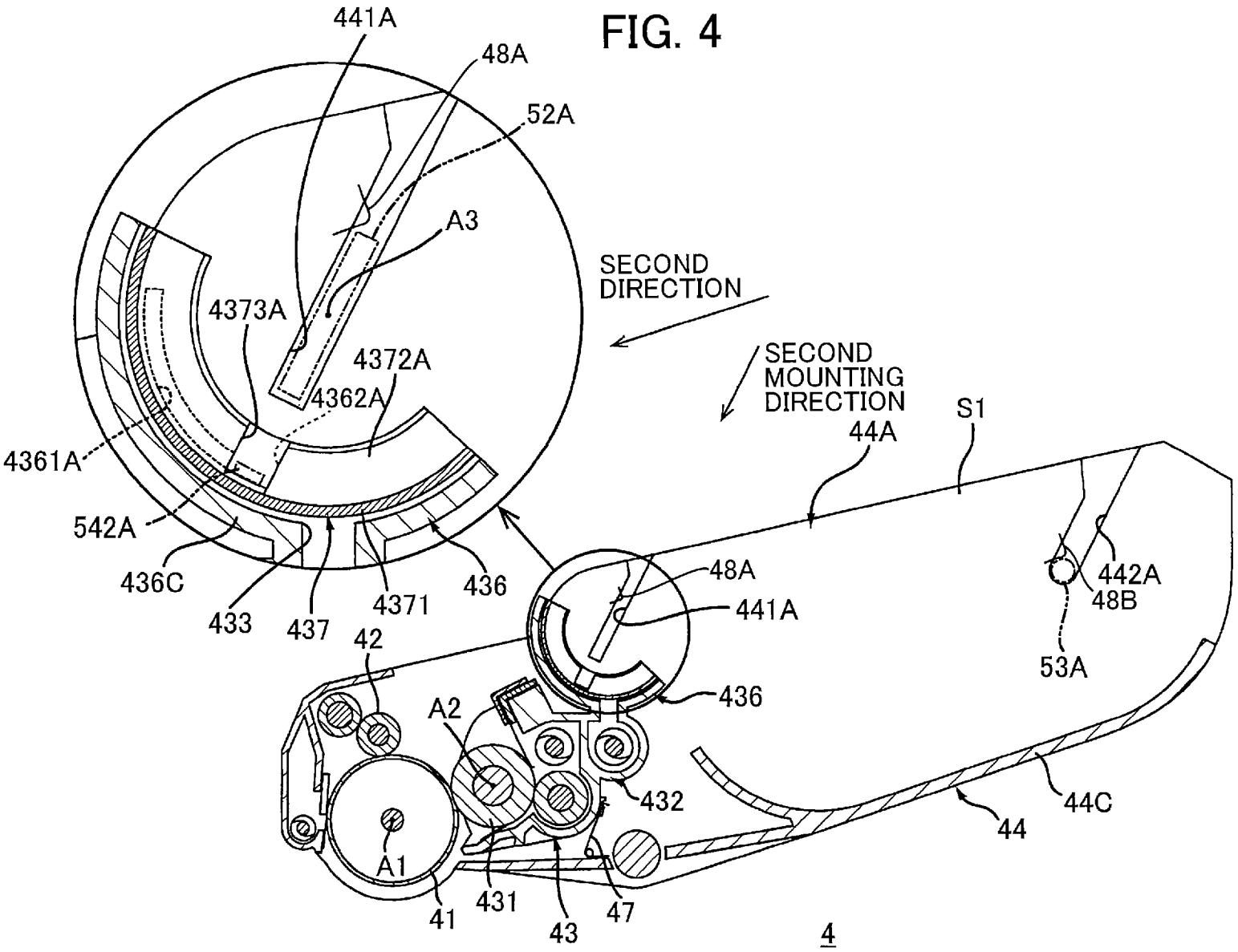
FIG. 4 is a cross-sectional view taken along a line IV-IV of FIG. 3, in a state where a developing shutter of the drum cartridge is in a developing closed position.
Figure 6:
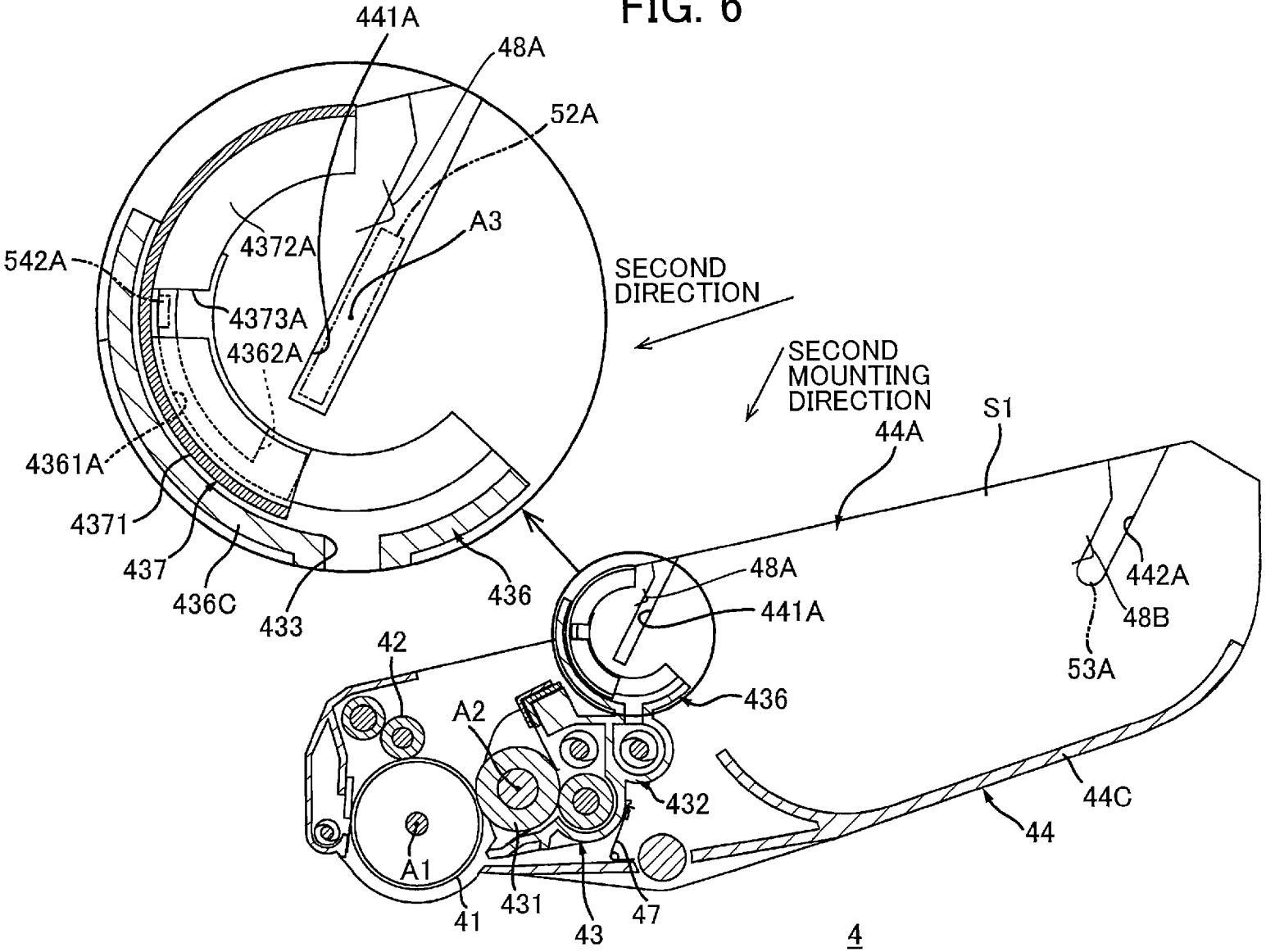
FIG. 6 is a cross-sectional view of the drum cartridge corresponding to FIG. 4 and illustrating a state where the developing shutter of the drum cartridge is in a developing open position.

The drum cartridge 4 includes the above-described photosensitive drum 41 (see FIG. 4), the above-described charging device 42 (see FIG. 4), the above-described developing device 43 (see FIG. 4), a drum frame 44 (see FIG. 3), the two projections 45A and 45B (see FIG. 3), the two projections 46A and 46B (see FIG. 3), a pair of pressing members 47 (see FIG. 4), and leaf springs 48A and 48B (see FIGS. 4 and 6).

As illustrated in FIG. 3, the drum frame 44 includes a side plate 44A positioned at one side in the first direction, a side plate 44B positioned at the other side in the first direction, and a bottom plate 44C.

2.1.1 Side Plate 44A

The side plate 44A is positioned at one end portion of the drum frame 44 in the first direction. The side plate 44A extends in a second direction. The second direction intersects with the first direction. Preferably, the second direction is orthogonal to the first direction. Specifically, the second direction extends from the developing axis A2 toward the drum axis A1. The side plate 44A has an inner surface S1 and an outer surface S2 in the first direction. The inner surface S1 is positioned between the outer surface S2 and the side plate 44B in the first direction. The side plate 44A is formed with a guide 441A (see FIG. 4), a guide 442A (see FIG. 4), an elongated slot 443A (see FIG. 5), and an elongated slot 444A (see FIG. 5).

As illustrated in FIG. 4, the guide 441A is positioned at the inner surface S1 of the side plate 44A. The guide 441A is positioned between the photosensitive drum 41 and the guide 442A in the second direction. The guide 441A is positioned at an opposite side of the photosensitive drum 41 with respect to the developing device 43. The guide 441A extends in a second mounting direction. The second mounting direction corresponds to the direction in which the toner cartridge 5 moves when the toner cartridge 5 is mounted to the drum cartridge 4. The second mounting direction intersects with both of the first direction and the second direction. Preferably, the second mounting direction is orthogonal to the first direction and intersects with the second direction. The guide 441A is a groove. Alternatively, the guide 441A may be a rib. The guide 441A is configured to guide a projection 52A of the toner cartridge 5 (see FIG. 7).

As illustrated in FIG. 4, the guide 442A is positioned at the inner surface S1 of the side plate 44A. The guide 442A is positioned apart from the guide 441A in the second direction. The guide 442A extends in the second mounting direction. The guide 442A is a groove.

Alternatively, the guide 442A may be a rib. The guide 442A is configured to guide a projection 53A of the toner cartridge 5 (see FIG. 7).

Figure 5:
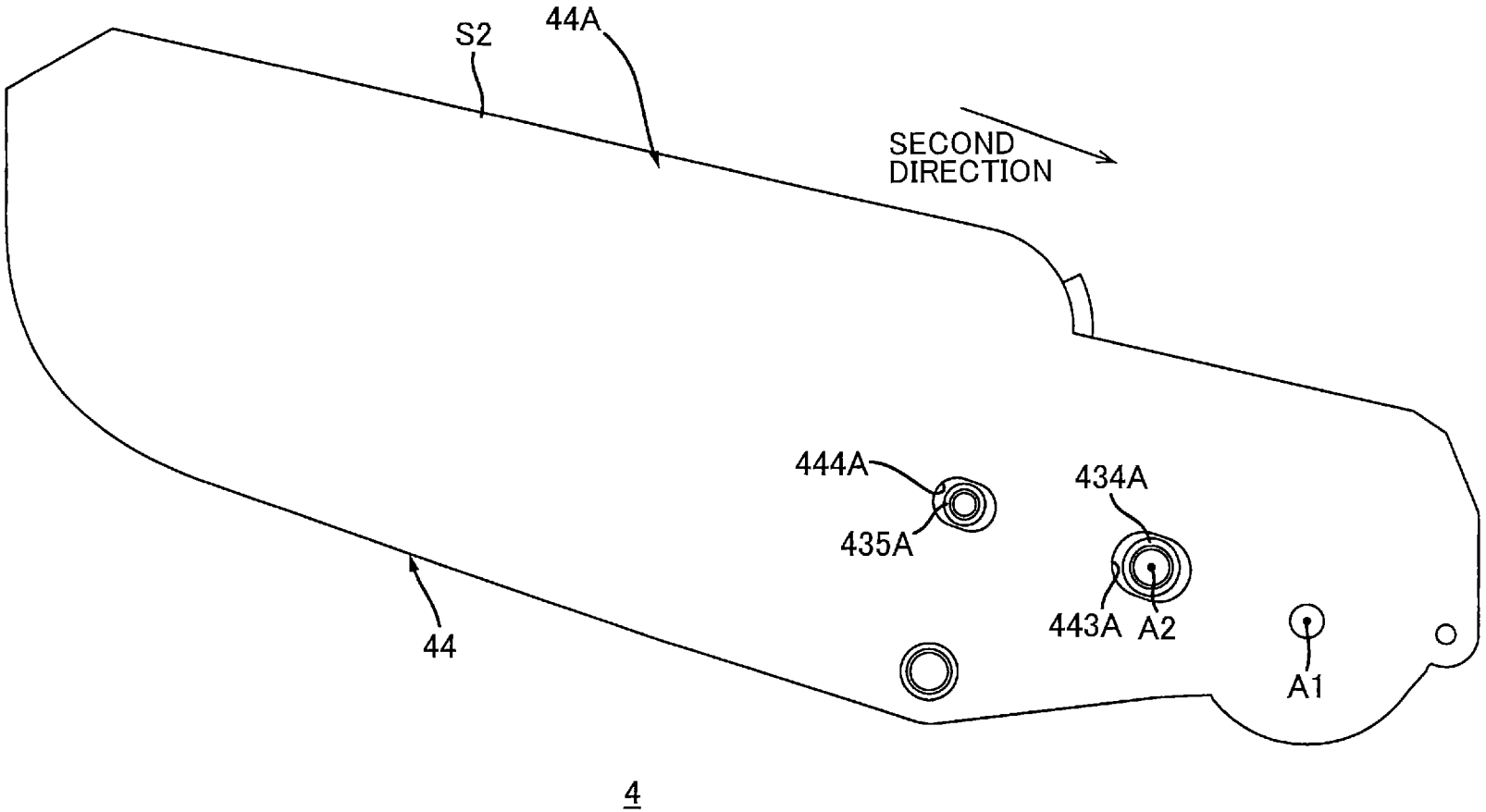
FIG. 5 is a side view of the drum cartridge shown in FIG. 3.

As illustrated in FIG. 5, the elongated slot 443A is a long through-hole elongated in the second direction.

The elongated slot 444A is positioned apart from the elongated slot 443A in the second direction. The elongated slot 444A is a long through-hole elongated in the second direction.

2.1.2 Side Plate 44B

As illustrated in FIG. 3, the side plate 44B is positioned at the other end portion of the drum frame 44 in the first direction. The side plate 44A is positioned apart from the side plate 44A in the first direction. The side plate 44B extends in the second direction. The side plate 44B has an inner surface S11 and an outer surface S12 in the first direction. The inner surface S11 is positioned between the outer surface S12 and the side plate 44A in the first direction. The side plate 44B is formed with a guide 441B, a guide 442B, an elongated slot 443B, and an elongated slot 444B.

The guide 441B is positioned at the inner surface S11 of the side plate 44B. The guide 441B has a shape identical to the shape of the guide 441A. The guide 441B is configured to guide a projection 52B of the toner cartridge 5 (see FIG. 7).

The guide 442B is positioned at the inner surface S11 of the side plate 44B. The guide 442B has a shape identical to the shape of the guide 442A. The guide 442B is configured to guide a projection 53B of the toner cartridge 5 (see FIG. 7).

The elongated slot 443B has a shape identical to the shape of the elongated slot 443A.

The elongated slot 444B has a shape identical to the shape of the elongated slot 444A.

2.1.3 Bottom Plate 44C

The bottom plate 44C is positioned between the side plate 44A and the side plate 44B in the first direction. The bottom plate 44C extends in the first direction. The bottom plate 44C has one end portion in the first direction connected to the side plate 44A. The bottom plate 44C has the other end portion in the first direction connected to the side plate 44B.

2.2 Projections 45A, 45B, 46A and 46B

The projection 45A is positioned on the outer surface S2 of the side plate 44A. The projection 45A extends in the first direction. The projection 45A has a columnar shape. In the present embodiment, the projection 45A is one end portion of a shaft that supports the photosensitive drum 41. The projection 45A extends along the drum axis A1.

The projection 45B is positioned on the outer surface S12 of the side plate 44B. The projection 45B extends in the first direction. The projection 45B has a columnar shape. In the present embodiment, the projection 45B is the other end portion of the shaft that supports the photosensitive drum 41. The projection 45B extends along the drum axis A1.

The projection 46A is positioned on the outer surface S2 of the side plate 44A. The projection 46A is positioned apart from the projection 45A in the second direction. The projection 46A extends in the first direction. The projection 46A has a columnar shape.

The projection 46B is positioned on the outer surface S12 of the side plate 44B. The projection 46B is positioned apart from the projection 45B in the second direction. The projection 46B extends in the first direction. The projection 46B has a columnar shape.

2.3 Detailed Configuration of Developing Device

As shown in FIGS. 3 and 4, the developing device 43 includes the above-described developing roller 431, the above-described developing casing 432, two projections 434A and 434B, two projections 435A and 435B, a receiving portion 436, and a developing shutter 437.

2.3.1 Detailed Configuration of Developing Casing

The developing casing 432 is positioned between the side plate 44A and the side plate 44B in the first direction. The developing casing 432 extends in the first direction. The developing casing 432 has a side surface S21 positioned at one side in the first direction and a side surface S22 positioned at the other side in the first direction. The side surface S21 opposes the inner surface S1 of the side plate 44A in the first direction. The side surface S22 opposes the inner surface S11 of the side plate 44B in the first direction.

2.3.2 Projections 434A, 434B, 435A and 435B

The projection 434A is positioned on the side surface S21. The projection 434A extends in the first direction. The projection 434A has a columnar shape. In the present embodiment, the projection 434A is one end portion of a shaft of the developing roller 431. The projection 434A extends along the developing axis A2. The projection 434A is fitted in the elongated slot 443A of the side plate 44A.

The projection 434B is positioned on the side surface S22. The projection 434B extends in the first direction. The projection 434B has a columnar shape. In the present embodiment, the projection 434B is the other end portion of the shaft of the developing roller 431. The projection 434B extends along the developing axis A2. The projection 434B is fitted in the elongated slot 443B of the side plate 44B.

The projection 435A is positioned on the side surface S21. The projection 435A is positioned apart from the projection 434A in the second direction. The projection 435A extends in the first direction. The projection 435A has a columnar shape. The projection 435A is fitted in the elongated slot 444A of the side plate 44A.

The projection 435B is positioned on the side surface S22. The projection 435B is positioned apart from the projection 434B in the second direction. The projection 435B extends in the first direction. The projection 435B has a columnar shape. The projection 435B is fitted in the elongated slot 444B of the side plate 44B.

The developing casing 432 is supported by the drum frame 44 with the projection 434A being fitted in the elongated slot 443A, the projection 434B being fitted in the elongated slot 443B, the projection 435A being fitted in the elongated slot 444A, and the projection 435B being fitted in the elongated slot 444B. In the state where the developing casing 432 is supported by the drum frame 44, the developing casing 432 is movable in the direction in which the elongated slots 443A, 443B, 444A and 444B are elongated. Thus, the developing casing 432 is movable in the second direction relative to the photosensitive drum 41 in the state where the developing casing 432 is supported by the drum frame 44.

2.3.3 Receiving Portion

The receiving portion 436 is configured to receive a toner shutter 54 of the toner cartridge 5 (see FIG. 7) in the state where the toner cartridge 5 is mounted to the drum cartridge 4. The toner shutter 54 will be described later. The receiving portion 436 is positioned between one end portion of the developing casing 432 in the first direction and the other end portion of the developing casing 432 in the first direction. The receiving portion 436 is positioned in the center of the developing casing 432 in the first direction.

As illustrated in FIG. 4, the receiving portion 436 is positioned on an upper surface of the developing casing 432. In the present embodiment, the receiving portion 436 and the developing casing 432 are integrated with each other. The receiving portion 436 may be a component separate from the developing casing 432 and may be attached to the upper surface of the developing casing 432. As illustrated in FIG. 3, the receiving portion 436 includes a side plate 436A positioned at one side in the first direction, a side plate 436B positioned at the other side in the first direction, and a bottom plate 436C.

The side plate 436A is positioned at one end portion of the receiving portion 436 in the first direction. The side plate 436A extends in a direction in which the developing shutter 437 moves. The side plate 436A is formed with a lock portion 4361A and a guide 4362A. In other words, the developing casing 432 includes the lock portion 4361A and the guide 4362A. The guide 4362A extends in the second mounting direction and is in continuous with the lock portion 4361A. As illustrated in FIG. 4, the lock portion 4361A extends in the direction in which the developing shutter 437 moves. The lock portion 4361A has a circular arc shape. In the present embodiment, the lock portion 4361A and the guide 4362A are grooves which are in communication with each other. Each of the lock portion 4361A and the guide 4362A may instead be defined by a pair of opposite ribs.

As illustrated in FIG. 3, the side plate 436B is positioned apart from the side plate 436A in the first direction. The side plate 436B is positioned at the other end portion of the receiving portion 436 in the first direction. The side plate 436B extends in the direction in which the developing shutter 437 moves. The side plate 436B is formed with a lock portion 4361B and a guide 4362B. The guide 4362B has a shape identical to the shape of the guide 4362A. The lock portion 4361B has a shape identical to the shape of the lock portion 4361A.

The bottom plate 436C is positioned between the side plate 436A and the side plate 436B in the first direction. The bottom plate 436C extends in the first direction and also extends in the direction in which the developing shutter 437 moves. As illustrated in FIG. 4, the bottom plate 436C has a circular arc shape when viewed in the first direction. In the present embodiment, the bottom plate 436C is formed with the toner inlet 433. In a case where the receiving portion 436 is a component separate from the developing casing 432, the bottom plate 436C may be formed with an opening that is continuous with the toner inlet 433 which is formed on the developing casing 432.

Although not illustrated, the receiving portion 436 preferably includes a sealing member. The sealing member entirely surrounds the toner inlet 433. The sealing member is positioned on an upper surface of the bottom plate 436C. The sealing member is configured to be in contact with the toner shutter 54 to seal the space between the toner shutter 54 and the receiving portion 436 in a state where the toner cartridge 5 is mounted in the drum cartridge 4, the developing shutter 437 is in a developing open position (described later), and the toner shutter 54 is in a toner open position (described later).

2.3.4 Developing Shutter 437

The developing shutter 437 is movable between a developing closed position (see FIG. 4) and the developing open position (see FIG. 6). The developing shutter 437 is pivotally movable between the developing closed position and the developing open position about an axis A3. The axis A3 extends in the first direction. The direction, in which the developing shutter 437 moves, intersects with the second mounting direction. As illustrated in FIG. 4, the developing shutter 437 is configured to close the toner inlet 433 when the developing shutter 437 is in the developing closed position. As illustrated in FIG. 6, the developing shutter 437 is configured to open the toner inlet 433 when the developing shutter 437 is in the developing open position.

As illustrated in FIG. 3, the developing shutter 437 includes a developing shutter main body 4371, a side plate 4372A positioned at one side in the first direction, and a side plate 4372B positioned at the other side in the first direction.

The developing shutter main body 4371 is positioned between the side plate 4372A and the side plate 4372B in the first direction. The developing shutter main body 4371 extends in the first direction and also extends in the direction in which the developing shutter 437 moves. As illustrated in FIG. 4, the developing shutter main body 4371 is a plate having a circular arc shape when viewed in the first direction.

As illustrated in FIG. 3, the side plate 4372A is positioned at one end portion of the developing shutter 437 in the first direction. The side plate 4372A opposes the side plate 436A of the receiving portion 436 in the first direction. The side plate 4372A extends in the direction in which the developing shutter 437 moves. As illustrated in FIG. 4, the side plate 4372A has a groove 4373A. The groove 4373A extends in the second mounting direction when the developing shutter 437 is in the developing closed position. The groove 4373A is overlapped with the guide 4362A of the side plate 436A as viewed in the first direction when the developing shutter 437 is in the developing closed position.

As illustrated in FIG. 3, the side plate 4372B is positioned at the other end portion of the developing shutter 437 in the first direction. The side plate 4372B opposes the side plate 436B of the receiving portion 436 in the first direction. The side plate 4372B extends in the direction in which the developing shutter 437 moves. The side plate 4372B has a groove 4373B. The groove 4373B extends in the second mounting direction when the developing shutter 437 is in the developing closed position. The groove 4373B is overlapped with the guide 4362B of the side plate 436B as viewed in the first direction when the developing shutter 437 is in the developing closed position.

2.4 Pair of Pressing Members 47

As illustrated in FIG. 4, the pair of pressing members 47 is configured to press the developing device 43 toward the photosensitive drum 41. In the present embodiment, each of the pair of pressing members 47 is a torsion spring. Each of the pair of pressing members 47 may instead be a compression coil spring. In the present embodiment, one of the pair of pressing members 47 is provided at one of a pair of opposite sides of the developing casing 432 in the first direction, and the other one of the pair of pressing members 47 is provided at the other one of the pair of opposite sides of the developing casing 432 in the first direction.

3. Detailed Configuration of Toner Cartridge 5

Now, with reference to FIGS. 3, 4, and 6 to 11, the toner cartridge 5 will be described in detail.

Figure 7:
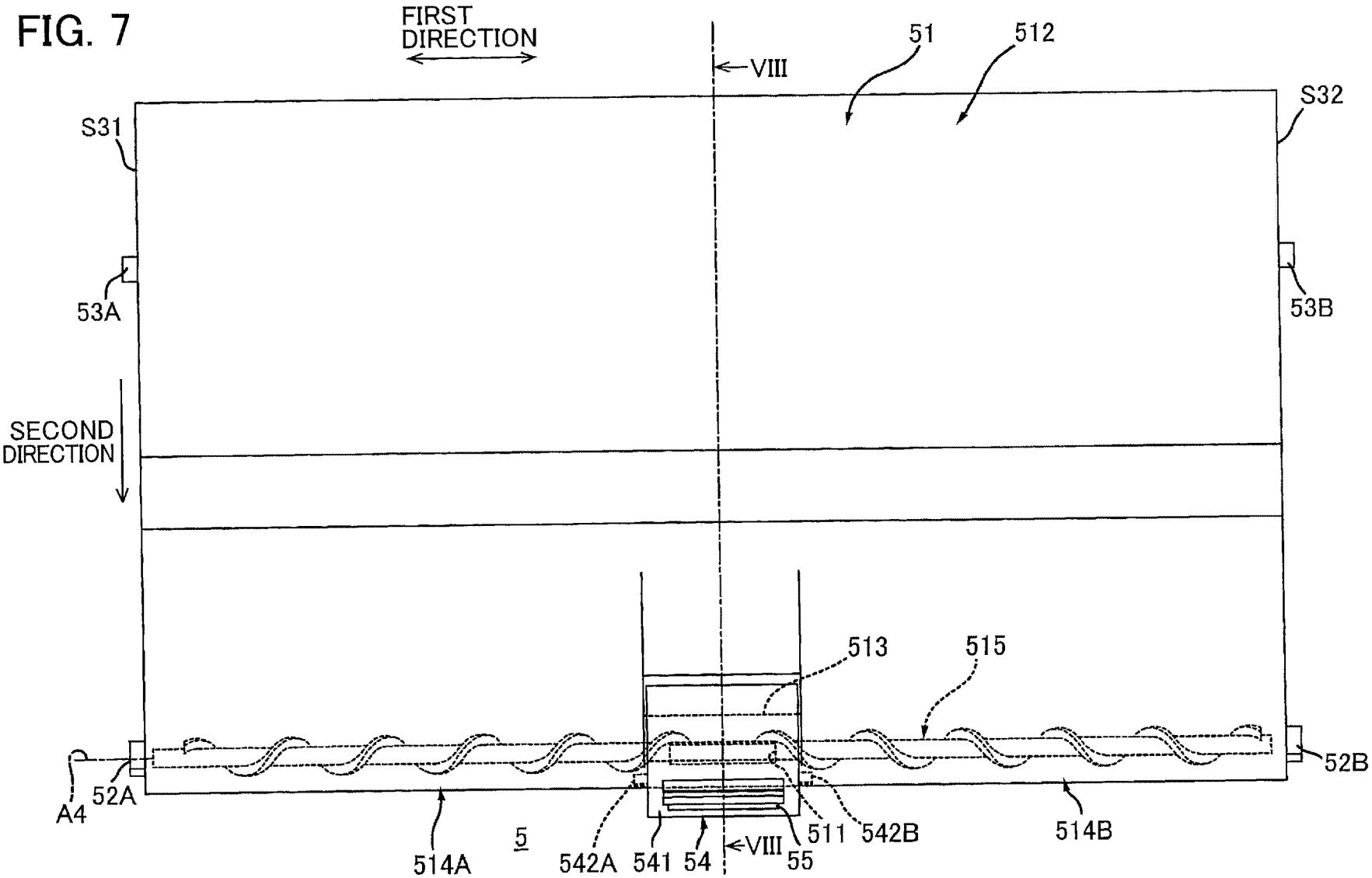
FIG. 7 is a plan view of the toner cartridge shown in FIG. 1.
Figure 8:
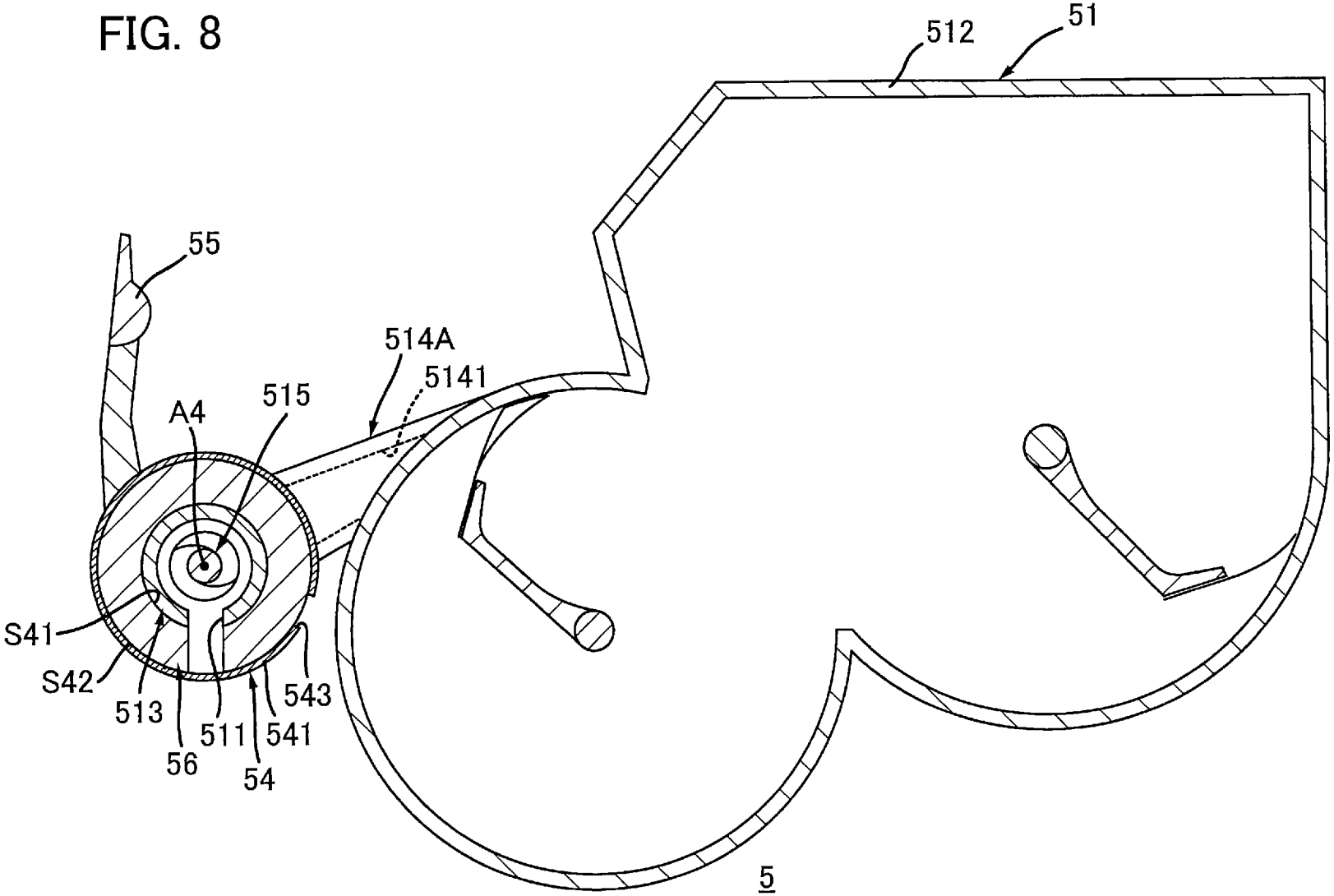
FIG. 8 is a cross-sectional view taken along a line VIII-VIII in FIG. 7 in a state where a toner shutter of the toner cartridge is in a toner closed position.

The toner cartridge 5 includes the above-described toner casing 51 (see FIG. 7), the two projections 52A and 52B (see FIG. 7), the two projections 53A and 53B (see FIG. 7), the toner shutter 54 (see FIG. 8), a handle 55 (see FIG. 8), and a cushion member 56 (see FIG. 8).

3.1 Detailed Configuration of Toner Casing 51

As illustrated in FIG. 7, the toner casing 51 extends in the first direction. The toner casing 51 has a side surface S31 positioned at one side in the first direction and a side surface S32 positioned at the other side in the first direction.

The toner casing 51 includes a toner container 512, a tubular portion 513, two connectors 514A and 514B, and an auger screw 515.

3.1.1 Toner Container 512

As illustrated in FIG. 8, the toner container 512 can store toner therein.

3.1.2 Tubular Portion 513

As illustrated in FIG. 7, the tubular portion 513 is positioned between one end portion of the toner casing 51 in the first direction and the other end portion of the toner casing 51 in the first direction. Specifically, the tubular portion 513 is positioned in the center of the toner casing 51 in the first direction. To be more specific, the tubular portion 513 is positioned between the connector 514A and the connector 514B in the first direction.

As illustrated in FIG. 8, the tubular portion 513 is positioned apart from the toner container 512. The tubular portion 513 extends in the first direction. The tubular portion 513 has a cylindrical shape. The tubular portion 513 is positioned radially inward of the toner shutter 54. The tubular portion 513 is formed with the toner outlet 511.

3.1.3 Connectors 514A and 514B

As illustrated in FIG. 7, the connector 514A is configured to connect the toner container 512 and one end portion of the tubular portion 513 in the first direction. The connector 514A extends from the toner container 512 in the second direction, and is connected to the one end portion of the tubular portion 513 in the first direction. As illustrated in FIG. 8, the connector 514A has a flow channel 5141 therein, and the flow channel 5141 allows toner to pass therethrough. The flow channel 5141 is configured to provide communication between an inner space of the toner container 512 and an inner space of the tubular portion 513. Thus, the toner in the toner container 512 can enter the tubular portion 513 via the flow channel 5141.

As illustrated in FIG. 7, the connector 514B is positioned apart from the connector 514A in the first direction. The connector 514B is configured to connect the toner container 512 and the other end portion of the tubular portion 513 in the first direction. The foregoing description of the connector 514A applies to the connector 514B as well. Therefore, the description of the connector 514B is omitted.

3.1.4 Auger Screw

The auger screw 515 is configured to convey toner in the connector 514A, the connector 514B, and the tubular portion 513 toward the toner outlet 511. The auger screw 515 extends in the first direction. The auger screw 515 is rotatable about an axis A4. The axis A4 extends in the first direction. The auger screw 515 is positioned in the connector 514A, the connector 514B, and the tubular portion 513.

3.2 Projections 52A, 52B, 53A, and 53B

Figure 9:
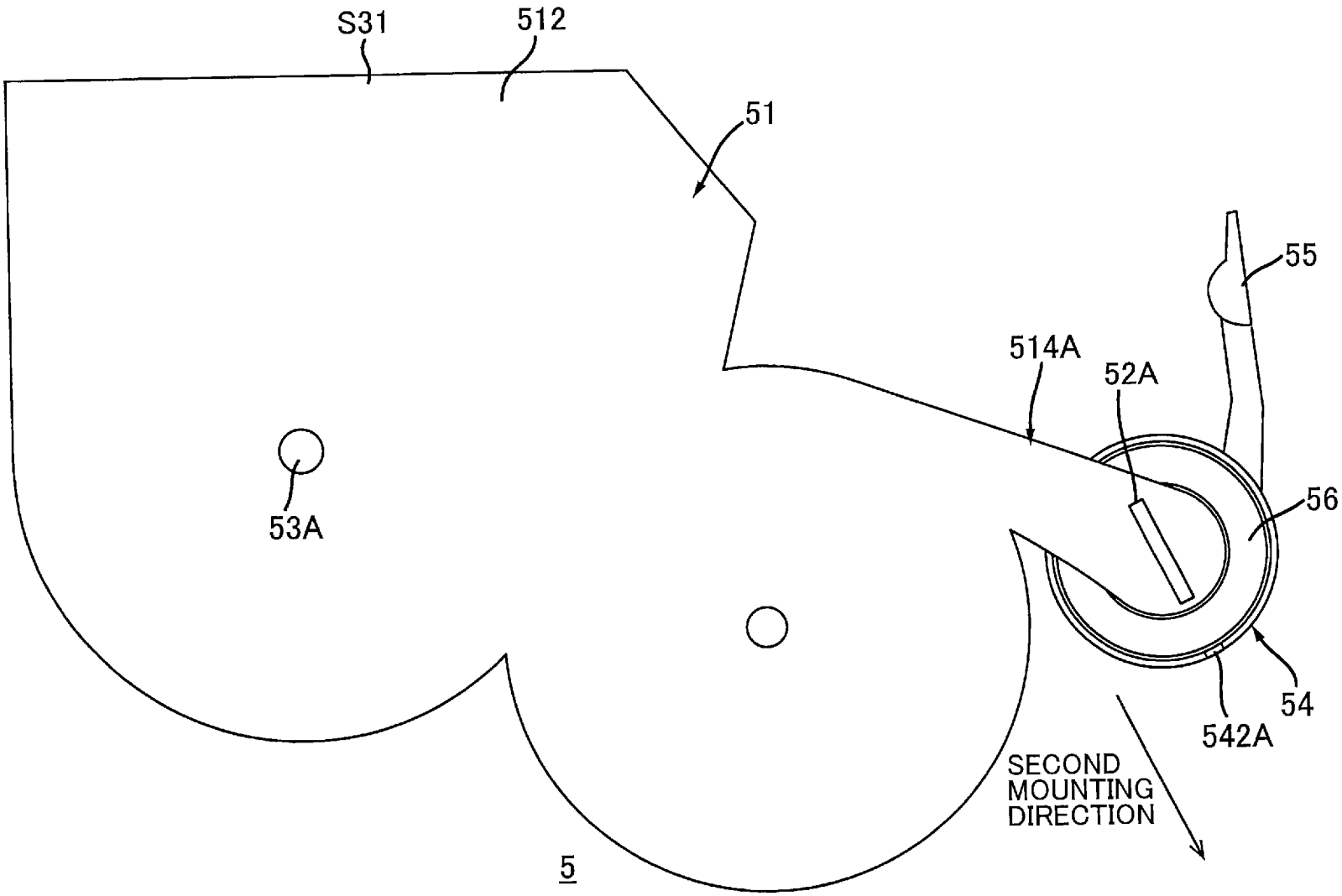
FIG. 9 is a side view of the toner cartridge shown in FIG. 7.

As illustrated in FIG. 7, the projection 52A is positioned on the side surface S31. In the present embodiment, the projection 52A projects from the side surface S31 in the first direction. The projection 52A may be attached to the side surface S31. As illustrated in FIG. 9, the projection 52A extends in the radial direction of the tubular portion 513. The projection 52A extends in the second mounting direction in the state where the toner cartridge 5 is mounted in the drum cartridge 4. The projection 52A is configured to be fitted in the guide 441A in the drum cartridge 4 (see FIG. 4) when the toner cartridge 5 is mounted to the drum cartridge 4.

As illustrated in FIG. 7, the projection 52B is positioned on the side surface S32. In the present embodiment, the projection 52B projects from the side surface S32 in the first direction. The projection 52B may be attached to the side surface S32. The projection 52B extends in the direction the same as the direction in which the projection 52A extends. The projection 52B is configured to be fitted in the guide 441B in the drum cartridge (see FIG. 3) when the toner cartridge 5 is mounted to the drum cartridge.

The projection 53A is positioned on the side surface S31. The projection 53A is positioned apart from the projection 52A in the second direction. The projection 53A projects from the side surface S31 in the first direction. The projection 53A may be attached to the side surface S31. The projection 53A has a columnar shape. The projection 53A is configured to be fitted in the guide 442A in the drum cartridge 4 (see FIG. 4) when the toner cartridge 5 is mounted to the drum cartridge 4.

The projection 53B is positioned on the side surface S32. The projection 53B is positioned apart from the projection 52B in the second direction. The projection 53B projects from the side surface S32 in the first direction. The projection 53B may be attached to the side surface S32. The projection 53B has a columnar shape. The projection 53B is configured to be fitted in the guide 442B in the drum cartridge (see FIG. 3) when the toner cartridge 5 is mounted to the drum cartridge 4.

The toner casing 51 of the toner cartridge 5 is fixed in position with respect to the drum cartridge 4 when the toner cartridge 5 is mounted to the drum cartridge 4, the projection 52A is fitted in the guide 441A, the projection 52B is fitted in the guide 441B, the projection 53A is fitted in the guide 442A, and the projection 53B is fitted in the guide 442B. When the toner casing is fixed in position relative to the drum cartridge 4, the toner casing 51 is prevented from being detached from the drum cartridge 4 when the projections 52A and 52B are restricted by the leaf springs 48A and 48B from coming off the guides 441A and 441B, respectively.

3.3 Toner Shutter 54

Figure 10:
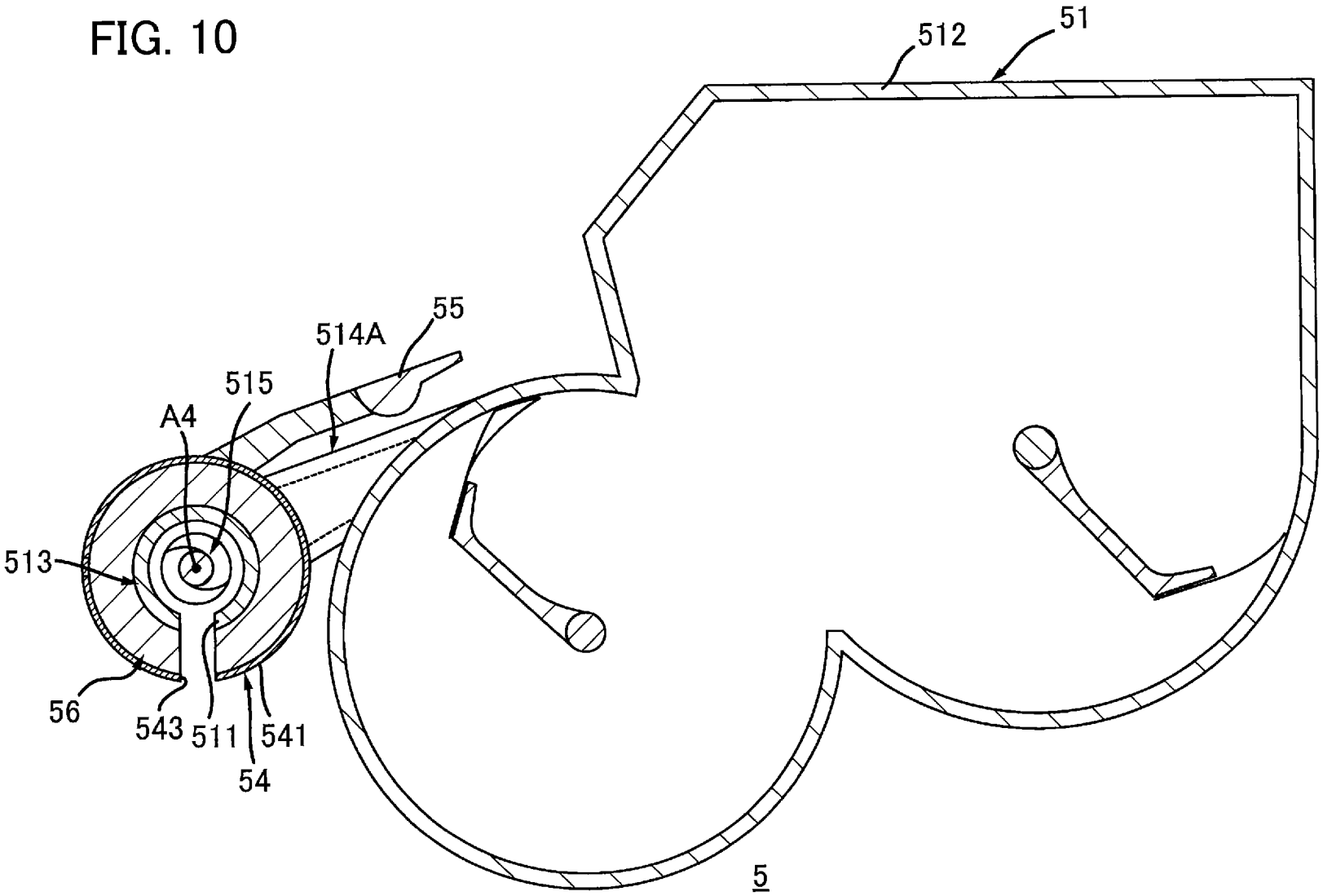
FIG. 10 is a cross-sectional view of the toner cartridge corresponding to FIG. 8 and illustrating a state where the toner shutter is in a toner open position.

The toner shutter 54 is movable between a toner closed position (see FIG. 8) and the toner open position (see FIG. 10). The toner shutter 54 is pivotally movable between the toner closed position and the toner open position about the axis A4. As illustrated in FIG. 8, the toner shutter 54 closes the toner outlet 511 when the toner shutter 54 is in the toner closed position. As illustrated in FIG. 10, the toner shutter 54 opens the toner outlet 511 when the toner shutter 54 is in the toner open position.

As illustrated in FIG. 7, the toner shutter 54 includes a toner shutter main body 541 and two projections 542A and 542B.

3.3.1 Toner Shutter Main Body

The toner shutter main body 541 extends in the first direction. In other words, the toner shutter 54 extends in the first direction. The toner shutter main body 541 has a cylindrical shape. In other words, the toner shutter 54 has a cylindrical shape. Therefore, the cylindrically-shaped toner shutter 54 rotates about its axis to move between the toner closed position (see FIG. 8) and the toner open position (see FIG. 10). This can reduce the space in which the toner shutter 54 moves.

As illustrated in FIG. 8, the toner shutter main body 541 is formed with a toner shutter opening 543. In other words, the toner shutter 54 has the toner shutter opening 543.

The toner shutter opening 543 is positioned apart from the toner outlet 511 in a circumferential direction when the toner shutter 54 is in the toner closed position. No part of the toner shutter opening 543 is in communication with the toner outlet 511 when the toner shutter 54 is in the toner closed position. The toner shutter opening 543 is closed by the toner shutter main body 541 when the toner shutter 54 is in the toner closed position. Thus, toner in the tubular portion 513 is prevented from being discharged.

On the other hand, as illustrated in FIG. 10, at least part of the toner shutter opening 543 is in communication with the toner outlet 511 when the toner shutter 54 is in the toner open position. Thus, toner in the tubular portion 513 is discharged via the toner outlet 511 and the toner shutter opening 543.

Figure 11:
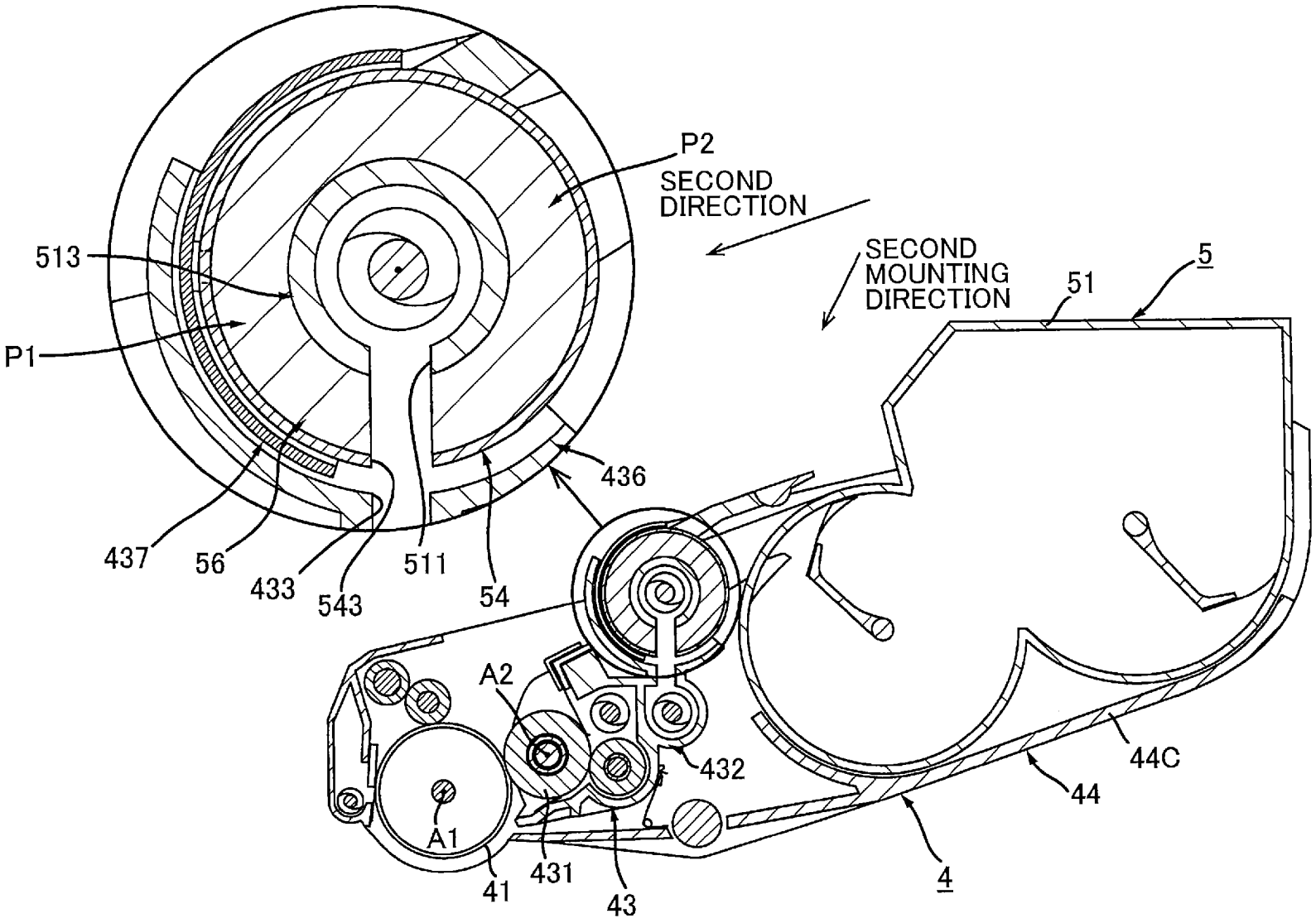
FIG. 11 is a cross-sectional view illustrating a state in which the toner cartridge is mounted to the drum cartridge, the developing shutter is in the developing open position, and the toner shutter is in the toner open position.

As illustrated in FIG. 11, the toner shutter opening 543 is in communication with the toner inlet 433 in the state where the drum cartridge 4 and the toner cartridge 5 are mounted in the main body casing 2, the developing shutter 437 is in the developing open position, and the toner shutter 54 is in the toner open position. Thus, the toner discharged from the toner outlet 511 enters the developing casing 432 via the toner shutter opening 543 and the toner inlet 433.

3.3.2 Projections 542A and 542B

As illustrated in FIG. 7, the projection 542A is positioned at one end portion of the toner shutter main body 541 in the first direction. The projection 542A is positioned between the toner shutter main body 541 and the projection 52A in the first direction. The projection 542A is positioned between the toner outlet 511 and the projection 52A in the first direction. The projection 542A extends in the first direction. The projection 542A extends from the toner shutter main body 541. More specifically, the projection 542A protrudes from the one end portion of the toner shutter main body 541 in the first direction. The projection 542A may be attached to the toner shutter main body 541.

The projection 542B is positioned at the other end portion of the toner shutter main body 541 in the first direction. The projection 542B is positioned between the toner shutter main body 541 and the projection 52B in the first direction. The projection 542B is positioned between the toner outlet 511 and the projection 52B in the first direction. The projection 542B extends in the first direction. The projection 542B extends from the toner shutter main body 541. More specifically, the projection 542B protrudes from the other end portion of the toner shutter main body 541 in the first direction. The projection 542B may be attached to the toner shutter main body 541.

The projection 542A is fitted in both of the groove 4373A in the developing shutter 437 (see FIG. 4) and the guide 4362A of the side plate 436A, and the projection 542B is fitted in both of the groove 4373B in the developing shutter 437 (see FIG. 3) and the guide 4362B of the side plate 436B when the toner cartridge 5 is mounted to the drum cartridge 4. Thus, the toner shutter 54 is engaged with the developing shutter 437 when the drum cartridge 4 and the toner cartridge 5 are mounted in the main body casing 2. The developing shutter 437 moves together with the toner shutter 54, with the projection 542A being fitted in the groove 4373A and the projection 542B being fitted in the groove 4373B.

In the state where the toner cartridge 5 is mounted in the drum cartridge 4, when the toner shutter 54 pivotally moves from the toner closed position to the toner open position, the projection 542A enters the lock portion 4361A from the guide 4362A and the projection 542B enters the lock portion 4361B from the guide 4362B. When the developing shutter 437 is in the developing open position, and the toner shutter 54 is in the toner open position, the projection 542A is fitted in the lock portion 4361A of the developing device 43 (see FIG. 6) and the projection 542B of the toner shutter 54 is fitted in the lock portion 4361B of the developing device 43 (see FIG. 3). Thus, the toner shutter 54 is engaged with the developing casing 432 in the state where the drum cartridge 4 and the toner cartridge 5 are mounted in the main body casing 2.

The toner shutter 54 is locked to the receiving portion 436 when the projection 542A is fitted in the lock portion 4361A and the projection 542B is fitted in the lock portion 4361B.

That "the toner shutter 54 is locked to the receiving portion 436" means that the toner shutter 54 is fixed to the receiving portion 436 and is immovable relative to the receiving portion 436 in a direction intersecting with the direction in which the toner shutter 54 moves. The direction, in which the toner shutter 54 moves, means the direction in which the toner shutter 54 moves between the toner closed position and the toner open position. In other words, when the toner shutter 54 is locked to the receiving portion 436, the toner shutter 54 is movable relative to the receiving portion 436 in the direction in which the toner shutter 54 moves but is not movable relative to the receiving portion 436 in the direction intersecting with the direction in which the toner shutter 54 moves.

When the toner shutter 54 is locked to the receiving portion 436, the toner shutter 54 becomes engaged with and secured to the developing casing 432. Thus, the toner shutter 54, while being fixed to the developing casing 432, moves relative to the toner casing 51 when the developing casing 432 moves relative to the photosensitive drum 41 in the state where the drum cartridge 4 and the toner cartridge 5 are mounted in the main body casing 2, the developing shutter 437 is in the developing open position, and the toner shutter 54 is in the toner open position.

Moreover, the toner cartridge 5 is locked to the drum cartridge 4 when the toner cartridge 5 is locked to the receiving portion 436. That "the toner cartridge 5 is locked to the drum cartridge 4" means that the toner cartridge 5 is incapable of being disengaged from the drum cartridge 4.

The toner cartridge 5 can be restrained from being disengaged from the drum cartridge 4 when the toner cartridge 5 is locked to the drum cartridge 4 in the state where the toner cartridge 5 is mounted in the drum cartridge 4, the developing shutter 437 is in the developing open position, and the toner shutter 54 is in the toner open position.

The projection 542A can be disengaged from the lock portion 4361A and the projection 542B can be disengaged from the lock portion 4361B in the state where the toner cartridge 5 is mounted in the drum cartridge 4, the developing shutter 437 is in the developing closed position, and the toner shutter 54 is in the toner closed position. Thus, the toner shutter 54 can be unlocked from the receiving portion 436. When the toner shutter 54 is unlocked from the receiving portion 436, the toner cartridge 5 becomes unlocked from the drum cartridge 4. When the toner cartridge 5 is unlocked from the drum cartridge 4, the toner cartridge 5 becomes disengageable from the drum cartridge 4.

3.4 Handle 55

As illustrated in FIG. 8, the handle 55 extends from the toner shutter main body 541. The handle 55 may be attached to the toner shutter main body 541. A user can operate the handle 55 to move the toner shutter 54. The user can move the toner shutter 54 easily by operating the handle 55.

3.5 Cushion Member 56

The cushion member 56 is disposed between the tubular portion 513 of the toner casing 51 and the toner shutter 54.

3.5.1 Material of Cushion Member

The cushion member 56 is made of an elastic material. In the present embodiment, the cushion member 56 is made of sponge. The cushion member 56 is disposed between the tubular portion 513 and the toner shutter 54 in a slightly compressed state.

As illustrated in FIG. 11, the cushion member 56 elastically deforms in response to movement of the toner shutter 54, which is engaged with the developing casing 432, when the developing casing 432 moves relative to the photosensitive drum 41 in the state where the drum cartridge 4 and the toner cartridge 5 are mounted in the main body casing 2, the developing shutter 437 is in the developing open position, and the toner shutter 54 is in the toner open position.

Specifically, when the developing casing 432 moves in a direction away from the photosensitive drum 41, the toner shutter 54 moves together with the developing casing 432 in the direction away from the photosensitive drum 41, but the toner casing 51, which is fixed in position with respect to the drum cartridge 4, does not move.

Accordingly, a portion P1 of the cushion member 56 that is positioned between the photosensitive drum 41 and the tubular portion 513 is compressed between the toner shutter 54 and the tubular portion 513. On the other hand, a portion P2 of the cushion member 56 that is positioned at an opposite side of the photosensitive drum 41 with respect to the tubular portion 513 recovers from the compressed state to fill the space between the toner shutter 54 and the tubular portion 513.

When the developing casing 432 moves in a direction approaching the photosensitive drum 41, the portion P1 of the cushion member 56 that is positioned between the photosensitive drum 41 and the tubular portion 513 recovers from the compressed state to fill the space between the toner shutter 54 and the tubular portion 513. On the other hand, the portion P2 of the cushion member 56 that is positioned at an opposite side of the photosensitive drum 41 with respect to the tubular portion 513 becomes compressed between the toner shutter 54 and the tubular portion 513.

In this manner, the cushion member 56 allows the toner shutter 54, which is engaged with the developing casing 432, to move relative to the toner casing 51 when the developing casing 432 moves relative to the photosensitive drum 41 in the state where the drum cartridge 4 and the toner cartridge 5 are mounted in the main body casing 2, the developing shutter 437 is in the developing open position, and the toner shutter 54 is in the toner open position.

3.5.2 Shape of Cushion Member

As illustrated in FIG. 8, the cushion member 56 has a cylindrical shape in the present embodiment. The cushion member 56 has a first surface S41 and a second surface S42.

The first surface S41 is an inner peripheral surface of the cushion member 56. The first surface S41 is in contact with an outer peripheral surface of the tubular portion 513 of the toner casing 51. In other words, the cushion member 56 is in contact with the tubular portion 513. The cushion member 56 may be adhered to the outer peripheral surface of the tubular portion 513 with an adhesive, for example.

The second surface S42 is an outer peripheral surface of the cushion member 56. The second surface S42 is in contact with an inner peripheral surface of the toner shutter 54. Thus, the cushion member 56 supports the toner shutter 54. When the toner shutter 54 moves between the toner closed position and the toner open position, the toner shutter 54 slides on the second surface S42 while being in contact with the second surface S42. This can restrain toner from leaking from between the toner shutter 54 and the cushion member 56 when the toner shutter 54 moves between the toner closed position and the toner open position.

The cushion member 56 does not cover the toner outlet 511. Thus, the cushion member 56 allows toner to be discharged from the toner outlet 511. The cushion member 56 entirely surrounds the toner outlet 511. The cushion member 56 that surrounds the toner outlet 511 has the first surface S41 in contact with the outer peripheral surface of the tubular portion 513 and the second surface S42 in contact with the inner peripheral surface of the toner shutter 54. Accordingly, the cushion member 56 seals between the toner casing 51 and the toner shutter 54 when the toner shutter 54 is in the toner closed position. This can restrain toner from leaking from between the toner casing 51 and the toner shutter 54.

3.5.3 Positioning of Cushion Member

As illustrated in FIGS. 3 and 7, the toner shutter 54 is received in the receiving portion 436 of the drum cartridge 4 when the toner cartridge 5 is mounted in the drum cartridge 4. In other words, the cushion member 56 (see FIG. 8) is positioned between the one end portion and the other end portion of the developing casing 432 in the first direction when the drum cartridge 4 and the toner cartridge 5 are mounted in the main body casing 2. Thus, the elasticity of the cushion member 56 is applied to the developing casing 432 uniformly in the first direction. This brings the developing roller 431 into contact with the photosensitive drum 41 with a uniform pressing force in the first direction.

To be more specific, the cushion member 56 is positioned in the center of the developing casing 432 in the first direction in the state where the drum cartridge 4 and the toner cartridge 5 are mounted in the main body casing 2. This brings the developing roller 431 into contact with the photosensitive drum 41 with an even more uniform pressing force in the first direction.

4. Advantages of Present Embodiment (1) According to the image forming apparatus 1, the cushion member 56 is disposed between the tubular portion 513 of the toner casing 51 and the toner shutter 54 as illustrated in FIG. 11.

Therefore, the toner shutter 54, while being engaged with the developing casing 432, is capable of moving relative to the toner casing 51 when the developing casing 432 moves relative to the photosensitive drum 41 in the state where the drum cartridge 4 and the toner cartridge 5 are mounted in the main body casing 2, the developing shutter 437 is in the developing open position, and the toner shutter 54 is in the toner open position.

This can restrain the position of the toner inlet 433 from changing relative to the toner shutter 54 even when the developing casing 432 moves relative to the photosensitive drum 41.

Consequently, in the configuration in which toner is supplied from the toner cartridge 5 to the developing casing 432 that is movable relative to the photosensitive drum 41, the toner supplied from the toner cartridge 5 to the developing casing 432 can be restrained from leaking.

(2) According to the image forming apparatus 1, the toner shutter 54 has the toner shutter opening 543 as illustrated in FIG. 8. The toner shutter opening 543 is out of communication with the toner outlet 511 when the toner shutter 54 is in the toner closed position.

On the other hand, as illustrated in FIG. 10, the toner shutter opening 543 is in communication with the toner outlet 511 when the toner shutter 54 is in the toner open position.

As illustrated in FIG. 11, the toner shutter opening 543 is in communication with the toner inlet 433 in the state where the drum cartridge 4 and the toner cartridge 5 are mounted in the main body casing 2, the developing shutter 437 is in the developing open position, and the toner shutter 54 is in the toner open position.

Therefore, the position of the toner inlet 433 can be restrained from changing relative to the toner shutter opening 543 when the developing casing 432 moves relative to the photosensitive drum 41in the state where the drum cartridge 4 and the toner cartridge 5 are mounted in the main body casing 2, the developing shutter 437 is in the developing open position, and the toner shutter 54 is in the toner open position.

Consequently, in the configuration in which toner is supplied from the toner cartridge 5 to the developing casing 432 that is movable relative to the photosensitive drum 41, toner supplied from the toner cartridge 5 to the developing casing 432 can be restrained from leaking more reliably.

(3) According to the image forming apparatus 1, the cushion member 56 seals the space between the tubular portion 513 of the toner casing 51 and the toner shutter 54 in the state where the toner shutter 54 is in the toner closed position as illustrated in FIG. 8.

Therefore, the cushion member 56 can restrain toner from leaking from between the tubular portion 513 of the toner casing 51 and the toner shutter 54.

(4) According to the image forming apparatus 1, as illustrated in FIGS. 8 and 10, when the toner shutter 54 moves between the toner closed position (see FIG. 8) and the toner open position (see FIG. 10), the toner shutter 54 slides on the second surface S42 of the cushion member 56 while being in contact with the second surface S42 of the cushion member 56.

This can restrain toner from leaking from between the toner shutter 54 and the cushion member 56 when the toner shutter 54 moves between the toner closed position and the toner open position.

(5) According to the image forming apparatus 1, the toner shutter 54 extends in the first direction as illustrated in FIGS. 7 and 8. The toner shutter 54 has a cylindrical shape.

Therefore, the cylindrically-shaped toner shutter 54 can rotate about its axis to move between the toner closed position (see FIG. 8) and the toner open position (see FIG. 10).

This can reduce the space in which the toner shutter 54 moves.

(6) According to the image forming apparatus 1, the toner shutter 54 is positioned between the one end portion and the other end portion of the toner casing 51 in the first direction as illustrated in FIG. 7. Moreover, as illustrated in FIG. 3, the receiving portion 436 is positioned between the one end portion and the other end portion of the developing casing 432 in the first direction.

Therefore, the cushion member 56 (see FIG. 8) is positioned between the one end portion and the other end portion of the developing casing 432 in the first direction in the state where the drum cartridge 4 and the toner cartridge 5 are mounted in the main body casing 2.

Thus, the elasticity of the cushion member 56 is applied to the developing casing 432 uniformly in the first direction.

This can bring the developing roller 431 into contact with the photosensitive drum 41 with a pressing force uniform in the first direction.

(7) According to the image forming apparatus 1, the cushion member 56 is positioned in the center of the developing casing 432 in the first direction in the state where the drum cartridge 4 and the toner cartridge 5 are mounted in the main body casing 2.

This can bring the developing roller 431 into contact with the photosensitive drum 41 with a pressing force even more uniform in the first direction.

(8) According to the image forming apparatus 1, the toner cartridge 5 includes the handle 55 for moving the toner shutter 54 as illustrated in FIGS. 8 and 10.

Therefore, the user can move the toner shutter 54 easily by operating the handle 55.

(9) According to the image forming apparatus 1, as illustrated in FIG. 1, the toner outlet 511 is positioned at a vertical level higher than the toner inlet 433 in the state where the drum cartridge 4 and the toner cartridge 5 are mounted in the main body casing 2.

Therefore, even if the distance between the toner outlet 511 and the toner inlet 433 increases due to an increase in the thickness of the cushion member 56, toner in the toner cartridge 5 can be supplied to the developing device 43 due to gravitational force.

(10) According to the image forming apparatus 1, as illustrated in FIG. 11, the toner cartridge 5 is locked to the drum cartridge 4 in the state where the toner cartridge 5 is mounted to the drum cartridge 4, the developing shutter 437 is in the developing open position, and the toner shutter 54 is in the toner open position.

This can restrain the toner cartridge 5 from being disengaged from the drum cartridge 4 in the state where the developing shutter 437 is in the developing open position and the toner shutter 54 is in the toner open position.

5. Modifications

Now, with reference to FIGS. 12A to 12C, some variations will be described. In the following variations, components similar to those described in the foregoing embodiment are given identical reference numerals, and the descriptions thereof are omitted.

Figure 12A:
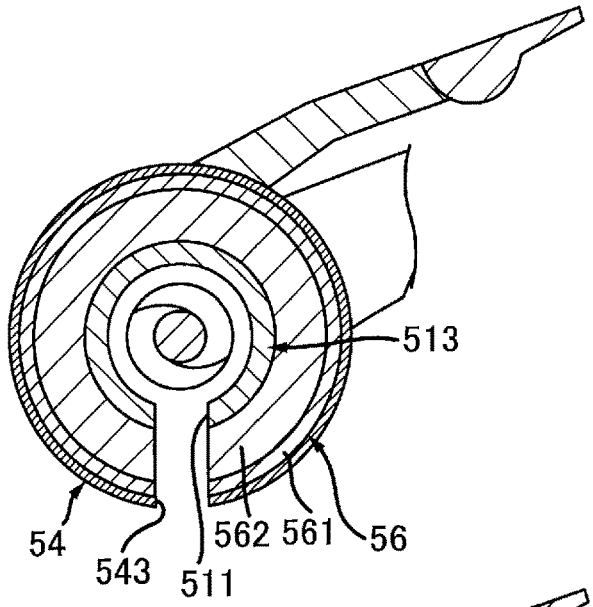
FIG. 12A is a cross-sectional view of an essential part of a toner cartridge according to a first modification.

(1) As illustrated in FIG. 12A, the cushion member 56 may include a first layer 561 and a second layer 562.

The first layer 561 is positioned a radially outward of the second layer 562. The first layer 561 may be adhered to the second layer 562 with an adhesive, for example. The first layer 561 is configured to be in contact with the toner shutter 54. The first layer 561 is made of a hard resin, for example. The first layer 561 does not deform when the developing casing 432 moves relative to the photosensitive drum 41 in the state where the drum cartridge 4 and the toner cartridge 5 are mounted in the main body casing 2, the developing shutter 437 is in the developing open position, and the toner shutter 54 is in the toner open position. This allows the toner shutter 54 to be supported more stably by the first layer 561.

The second layer 562 is positioned between the first layer 561 and the tubular portion 513 of the toner casing 51. The second layer 562 may be adhered to the outer peripheral surface of the tubular portion 513 with an adhesive, for example. The second layer 562 is softer than the first layer 561. The second layer 562 is made of a elastic material, such as sponge, for example. The second layer 562 elastically deforms when the developing casing 432 moves relative to the photosensitive drum 41 in the state where the drum cartridge 4 and the toner cartridge 5 are mounted in the main body casing 2, the developing shutter 437 is in the developing open position, and the toner shutter 54 is in the toner open position. Thus, the second layer 562 allows the toner shutter 54 to move relative to the toner casing 51.

(2) The cushion member 56 may not be cylindrical. The toner cartridge 5 may include a plurality of cushion members 56.

Figure 12B:
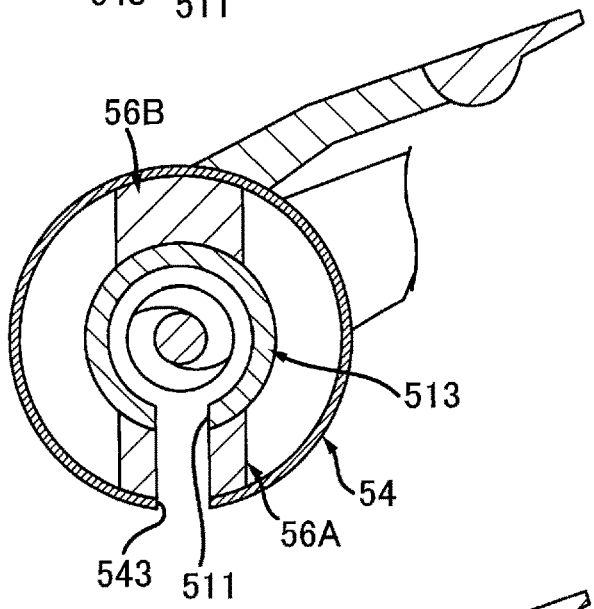
FIG. 12B is a cross-sectional view of a toner cartridge according to a second modification.

Specifically, as illustrated in FIG. 12B, the toner cartridge 5 may include two cushion members 56A and 56B. The cushion member 56A surrounds the toner outlet 511 in all direction as viewed in the vertical direction. The cushion member 56B is positioned at an opposite side of the cushion member 56A with respect to the tubular portion 513. In this case, the cushion members 56A and 56B may each have a rod shape extending in the first direction.

Figure 12C:
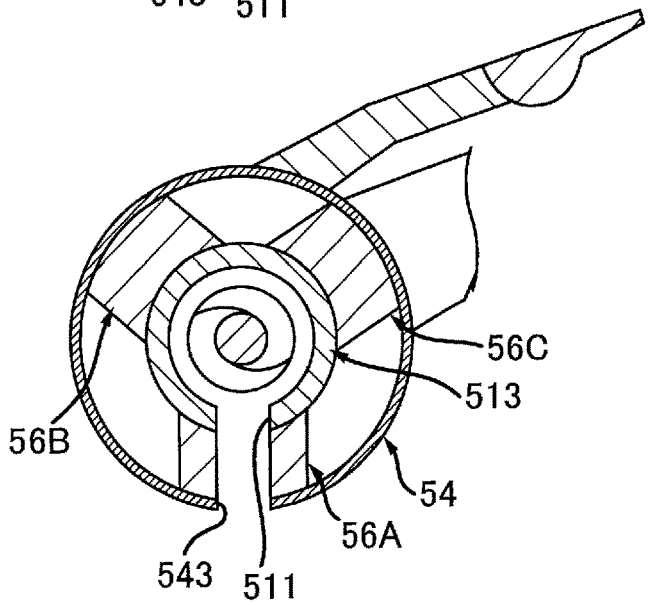
FIG. 12C is a cross-sectional view of a toner cartridge according to a third modification.

As illustrated in FIG. 12C, the toner cartridge 5 may include three cushion members 56A, 56B, and 56C. The cushion member 56A entirely surrounds the toner outlet 511. The cushion members 56B and 56C are each positioned apart from the cushion member 56A in the circumferential direction of the tubular portion 513. In this case, the cushion members 56A, 56B, and 56C each have a rod shape extending in the first direction.

(3) The tubular portion 513 may not be cylindrical. The tubular portion 513 may have a polygonal tubular shape, such as a rectangular tubular shape, a hexagonal tubular shape, or an octagonal tubular shape. In the case where the tubular portion 513 has a polygonal tubular shape, the cushion member 56 may have a tubular shape formed with a through-hole whose shape is identical to the outer shape of the tubular portion 513. In this case, the cushion member 56 may not be adhered to the peripheral surface of the tubular portion 513.

While the description has been made in detail with reference to the specific embodiments and variations thereof, it would be apparent to those skilled in the art that various changes and modifications may be made therein without departing from the spirit and scope of the above described embodiment and variations.

What is claimed is:

1. An image forming apparatus comprising:

a main body casing;

a drum cartridge attachable in the main body casing, the drum cartridge comprising:

a photosensitive drum rotatable about a drum axis which extends in a first direction; and a developing device configured to supply toner to the photosensitive drum; and a toner cartridge attachable in the main body casing, the toner cartridge being configured to supply toner to the developing device in a state where the drum cartridge and the toner cartridge are attached in the main body casing, the developing device comprising:

a developing roller rotatable about a developing axis which extends in the first direction;

a developing casing supporting the developing roller, the developing casing being movable relative to the photosensitive drum in a second direction which crosses the first direction, the developing casing being formed with a toner inlet configured to allow toner supplied from the toner cartridge into the developing casing in the state where the drum cartridge and the toner cartridge are attached in the main body casing; and a developing shutter movable between a developing closed position and a developing open position, the developing shutter being configured to close the toner inlet when the developing shutter is in the developing closed position, the developing shutter being configured to open the toner inlet when the developing shutter is in the developing open position, the toner cartridge comprising:

a toner casing configured to store toner therein, the toner casing being formed with a toner outlet which is configured to discharge toner from an inside of the toner casing;

a toner shutter movable between a toner closed position and a toner open position, the toner shutter being configured to close the toner outlet when the toner shutter is in the toner closed position, the toner shutter being configured to open the toner outlet when the toner shutter is in the toner open position, the toner shutter being configured to be engaged with the developing casing in the state where the drum cartridge and the toner cartridge are attached in the main body casing; and a cushion member positioned between the toner casing and the toner shutter, wherein the cushion member is configured to allow the toner shutter, while the toner shutter is engaged with the developing casing, to move relative to the toner casing when the developing casing moves relative to the photosensitive drum in a state where the drum cartridge and the toner cartridge are attached in the main body casing, the developing shutter is in the developing open position, and the toner shutter is in the toner open position.

2. The image forming apparatus according to claim 1, wherein the toner shutter, which is engaged with the developing casing, is locked to the developing casing, and wherein the toner shutter, which is locked to the developing casing, moves relative to the toner casing when the developing casing moves relative to the photosensitive drum in the state where the drum cartridge and the toner cartridge are attached in the main body casing, the developing shutter is in the developing open position, and the toner shutter is in the toner open position.

3. The image forming apparatus according to claim 1, wherein the toner shutter is formed with a toner shutter opening, the toner shutter opening being out of communication with the toner outlet in a state where the toner shutter is in the toner closed position, the toner shutter opening being in communication with the toner outlet in a state where the toner shutter is in the toner open position, and wherein the toner shutter opening is in communication with the toner inlet in the state where the drum cartridge and the toner cartridge are attached in the main body casing, the developing shutter is in the developing open position, and the toner shutter is in the toner open position.

4. The image forming apparatus according to claim 1, wherein the cushion member surrounds the toner outlet, and wherein, in the state where the toner shutter is in the toner closed position, the cushion member seals a space between the toner casing and the toner shutter.

5. The image forming apparatus according to claim 1, wherein the cushion member includes a first surface and a second surface, the first surface being in contact with the toner casing, the second surface being in contact with the toner shutter.

6. The image forming apparatus according to claim 5, wherein, when the toner shutter moves between the toner closed position and the toner open position, the toner shutter slides on the second surface of the cushion member, while being in contact with the second surface of the cushion member.

7. The image forming apparatus according to claim 1, wherein the toner shutter has a cylindrical shape extending in the first direction.

8. The image forming apparatus according to claim 7, wherein the toner casing has a tubular part extending in the first direction, the tubular part being positioned inside the toner shutter and being formed with the toner outlet, and wherein the cushion member is in contact with the tubular part of the toner casing.

9. The image forming apparatus according to claim 1, wherein the cushion member is positioned between one end portion and another end portion of the developing casing in the first direction in the state where the drum cartridge and the toner cartridge are attached in the main body casing.

10. The image forming apparatus according to claim 9, wherein the cushion member is positioned in a central portion of the developing casing in the first direction in the state where the drum cartridge and the toner cartridge are attached in the main body casing.

11. The image forming apparatus according to claim 1, wherein the cushion member includes a first layer and a second layer, the first layer being in contact with the toner shutter, the second layer being positioned between the first layer and the toner casing, and wherein the second layer is softer than the first layer.

12. The image forming apparatus according to claim 11, wherein the second layer elastically deforms and the first layer does not deform when the developing casing moves relative to the photosensitive drum in the state where the drum cartridge and the toner cartridge are attached in the main body casing, the developing shutter is in the developing open position, and the toner shutter is in the toner open position.

13. The image forming apparatus according to claim 1, wherein the toner cartridge further comprises a handle configured to move the toner shutter.

14. The image forming apparatus according to claim 1, wherein the toner outlet is positioned at a vertical level higher than the toner inlet in the state where the drum cartridge and the toner cartridge are attached in the main body casing.

15. The image forming apparatus according to claim 1, wherein the toner cartridge is mountable in the drum cartridge, wherein the drum cartridge, in which the toner cartridge is mounted, is mountable in the main body casing, wherein the toner cartridge is mounted in the main body casing in the state where the drum cartridge, in which the toner cartridge is mounted, is mounted in the main body casing.

16. The image forming apparatus according to claim 1, wherein the toner cartridge is fixed in position with respect to the drum cartridge in a state where the toner cartridge is mounted in the drum cartridge, and wherein the drum cartridge is fixed in position with respect to the main body casing in a state where the drum cartridge is mounted in the main body casing.

17. The image forming apparatus according to claim 16, wherein the toner cartridge is locked to the drum cartridge in the state where the drum cartridge and the toner cartridge are attached in the main body casing, the developing shutter is in the developing open position, and the toner shutter is in the toner open position.

* * * * *